US008391738B2

(12) United States Patent
Hasegawa

(10) Patent No.: US 8,391,738 B2
(45) Date of Patent: Mar. 5, 2013

(54) IMAGE HEATING APPARATUS EXECUTING A CORRECTION MODE WHEN THE DETECTED AMOUNTS OF SLACK AT DIFFERENT ENDS OF A RECORDING MATERIAL ARE DIFFERENT

(75) Inventor: Kazuhiro Hasegawa, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 80 days.

(21) Appl. No.: 12/952,597

(22) Filed: Nov. 23, 2010

(65) Prior Publication Data

US 2011/0123212 A1 May 26, 2011

(30) Foreign Application Priority Data

Nov. 25, 2009 (JP) ..... 2009-267151

(51) Int. Cl.
*G03G 15/20* (2006.01)

(52) U.S. Cl. ..... 399/68; 399/341

(58) Field of Classification Search ..... 399/68, 399/341, 396, 400, 406, 324
See application file for complete search history.

(56) References Cited

U.S. PATENT DOCUMENTS

| | | | |
|---|---|---|---|
| 7,200,354 | B2 | 4/2007 | Nakamoto et al. |
| 7,406,288 | B2 | 7/2008 | Nakamoto et al. |
| 7,457,576 | B2 | 11/2008 | Takada et al. |
| 7,466,950 | B2 | 12/2008 | Matsuura et al. |
| 7,542,711 | B2 | 6/2009 | Nakamoto et al. |
| 7,596,348 | B2 | 9/2009 | Nakamoto et al. |
| 7,792,477 | B2 | 9/2010 | Nakamoto et al. |
| 7,844,208 | B2 | 11/2010 | Hayashi et al. |
| 2010/0303495 | A1 * | 12/2010 | Kurosu ..... 399/68 |

FOREIGN PATENT DOCUMENTS

| | | |
|---|---|---|
| JP | 04-245275 | 9/1992 |
| JP | 2000-075710 | 3/2000 |
| JP | 2000-221821 | 8/2000 |
| JP | 2001-282021 | 10/2001 |
| JP | 2002-351237 | 12/2002 |
| JP | 2007-309997 | 11/2007 |
| JP | 2009-134080 | 6/2009 |

OTHER PUBLICATIONS

Machine English Translation of JP 2000-075710 published on Mar. 14, 2000.*

Machine English Translation of JP 2009-134080 published on Jun. 18, 2009.*

Machine English Translation of JP 2002-351237 published on May 22, 2001.*

* cited by examiner

*Primary Examiner* — Walter L Lindsay, Jr.
*Assistant Examiner* — Billy J Lactaoen
(74) *Attorney, Agent, or Firm* — Fitzpatrick, Cella, Harper & Scinto

(57) ABSTRACT

An image heating apparatus includes: a first heater, having a nip through which a sheet passes, for heating toner image on the sheet; a second heater, having a nip through which the sheet passes, capable of heating the toner image on the sheet having passed through the first heater; a changer for changing the feeding speed of the sheet of the second image heater; two detectors for detecting the amount of slack of the sheet at one and the other ends of the sheet when the sheet is nipped by both of the nips; an adjuster adjusting the distance between the first and second heaters at the one and the other ends; and a portion for executing a correction mode when the amounts of slack detected by the detectors are different from each other, so that after the adjuster reduces the distance, the feeding speed is controlled.

9 Claims, 10 Drawing Sheets

IMAGE HEATING APPARATUS EXECUTING A CORRECTION MODE WHEN THE DETECTED AMOUNTS OF SLACK AT DIFFERENT ENDS OF A RECORDING MATERIAL ARE DIFFERENT

FIELD OF THE INVENTION AND RELATED ART

The present invention relates to an image heating apparatus which is desirable as a fixing apparatus to be mounted in an image forming apparatus such as an electrophotographic copying machine, an electrophotographic printer, etc.

In the field of an image forming apparatus such as an electrophotographic copying machine, a printer, etc., demands have been increasing for an image forming apparatus which can adjust the glossiness level of output images, in accordance with the glossiness level of the sheet of a recording medium. An example of such an image forming apparatus is an image forming apparatus which outputs images which are relatively high in glossiness when it is used to output images on coated paper, photographic printing paper, etc., and yet, outputs images which are relatively low in glossiness when it is used for images such as black-and-white texts and/or color texts for business, on ordinary paper or the like.

As an example of the embodiment of the technologies capable of satisfying these demands, there have been known image forming apparatuses equipped with two or more fixing apparatuses (fixing devices) arranged in the so-called tandem fashion. The greater the number of fixing apparatuses provided to an image forming apparatus, the wider the range of control that can be exercised by the image forming apparatus over the amount of heat and pressure, applied to a toner image, which affect the glossiness of outputs images. That is, increasing the number of fixing apparatuses in an image forming apparatus can widen the glossiness range in which the image forming apparatus can output images.

As a structural arrangement for positioning two or more fixing apparatuses in tandem in an image forming apparatus, the following may be listed. For example, Japanese Laid-open Patent Application H04-245275 discloses an image forming apparatus which can output glossy images by being provided with two fixing apparatuses, each of which comprises a heat roller and a pressure roller, which are kept pressed upon each other. More specifically, in the case of this image forming apparatus, after a toner image is transferred onto a sheet of a recording paper, the sheet is sequentially conveyed through the first and second compressing portions so that the toner image on the sheet will be glossier than it will be if the sheet is conveyed through only a single compressing portion. Further, Japanese Laid-open Patent Application 2000-221821 discloses a technology for controlling the glossiness level at which an image forming apparatus outputs images. More specifically, according to this technology, an image forming apparatus is provided with two or more fixing devices which are sequentially positioned in tandem in terms of the recording medium (paper) conveyance direction, and a desired level of glossiness is achieved by changing the amount of heat applied to the recording medium by changing the number of fixing apparatuses (fixing nips) to be used in the image forming apparatus for fixation, and also, in the selection of the fixing apparatuses to be used for fixation (that is, changing the location of fixation). Further, Japanese Laid-open Patent Application 2000-075710 discloses a technology for preventing the image on a sheet of a recording medium from being shifted in location by the tension to which the sheet is subjected between the two fixing devices (fixation nips). More specifically, according to this technology, the recording medium conveyance speed of the first fixing device is made faster than the second fixing device, so that a sheet of the recording medium is slightly slackened between the two fixing devices.

A fixing apparatus thermally fixes the toner image on a sheet of a recording medium by conveying the sheet of the recording medium (on which the toner image is present) through its fixation nip which is high in temperature and pressure. Thus, it is substantial in the amount of force it applies to a sheet of a recording medium to convey the sheet. Further, it is likely to be non-uniform in the temperature and/or pressure distribution in terms of the lengthwise direction of the nip. Also in terms of the lengthwise direction of the nip, it is likely to be non-uniform in the nip width because of the non-uniformity in the preciseness of the components which form the nip. Therefore, the nip is likely to become non-uniform in the recording medium conveyance speed in terms of its lengthwise direction. Thus, when a large sheet of a recording medium is in the two fixing devices of a fixing apparatus of the tandem-type at the same time while it is being conveyed through the fixing apparatus, the portion of the sheet that is being slackened between the two fixing devices sometimes becomes substantially non-uniform in the amount of slack in terms of the widthwise direction of the path of the sheet. Therefore, if the amount of slack becomes substantial, the sheet sometimes comes into contact with the components forming the nip, at one side or the other side in terms of the lengthwise direction of the nip. The contact between the sheet of the recording medium and these components sometimes causes the toner image on the sheet of the recording medium to be shifted relative to the sheet and/or scratched, resulting in the outputting of defective copies (images) by the image forming apparatus.

As the means for minimizing the amount of slack of a sheet of the recording medium as described above, there is the structural arrangement disclosed in Japanese Laid-open Patent Application 2002-351237. This structural arrangement makes it possible to change the recording medium conveyance speed of the downstream fixation unit.

However, this structural arrangement suffers from the following problem. That is, assuming that a sheet of a recording medium is being conveyed through the fixing apparatus structured as described above, and there is a difference in the amount of the slack between one end of the sheet and the other in terms of the lengthwise direction of the fixing apparatus. If the recording medium conveyance speed of the downstream fixation unit is adjusted to reduce at the slackened portion of the sheet the amount of slack on one end, the amount of slack on the one end of the sheet is reduced, but it may be excessively pulled by the downstream fixation on the other side, although whether or not this phenomenon occurs depends on the difference in the amount of slack between one side of the sheet and the other.

SUMMARY OF THE INVENTION

Thus, the primary object of the present invention is to provide an image heating apparatus with a significantly smaller non-uniform recording medium conveyance speed across a direction perpendicular to the recording medium conveyance direction, thereby providing a significantly more stable recording medium conveyance than any of the prior art image heating apparatuses.

According to an aspect of the present invention, there is provided an image heating apparatus comprising: first image heating means, having a nip through which a recording material passes, for heating toner image on the recording material; second image heating means, having a nip through which the recording material passes, capable of heating the toner image on the recording material having passed through the nip of the first image heating means; speed changing means for changing a feeding speed of the recording material of the second image heating means; a first detector for detecting an amount of slack of the recording material at one end of the recording material when the recording material is nipped by both of the nips of the first image heating means and the nip of the second image heating means; a second detector for detecting an amount of slack of the recording material at the other end of the recording material when the recording material is nipped by both of the nip of the first image heating means and the nip of the second image heating means; adjusting means for adjusting a distance between the first image heating means and the second image heating means at the one end and a distance between the first image heating means and the second image heating means at the other end; and an executing portion for executing a correction mode when the amount of slack at the one end detected by the first detector and the amount of slack at the other end detected by the second detector are different from each other, wherein the executing portion executes the correction mode in which after the adjusting means reduces the difference, the speed changing means is controlled.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 6(*b*) is a schematic sectional view of the fixation roller shifting mechanism, and shows its structure.

FIGS. 12(*b*) and 12(*c*) are schematic drawings which show the patterns, respectively, in which the sections 24*a*, 24*b*, 24*c* of the halogen light are turned on and off, and which are different from FIG. 12(*a*) in terms of the ratio with which the three sections 24*a*, 24*b*, and 24*c* of the halogen heater are turned on per unit length of time.

DETAILED DESCRIPTION OF THE PREFERRED EMBODIMENTS

Hereafter, the preferred embodiments of the present invention are described with reference to the appended drawings.

Embodiment 1

(A) General Structure of Image Forming Apparatus

Figure 1:
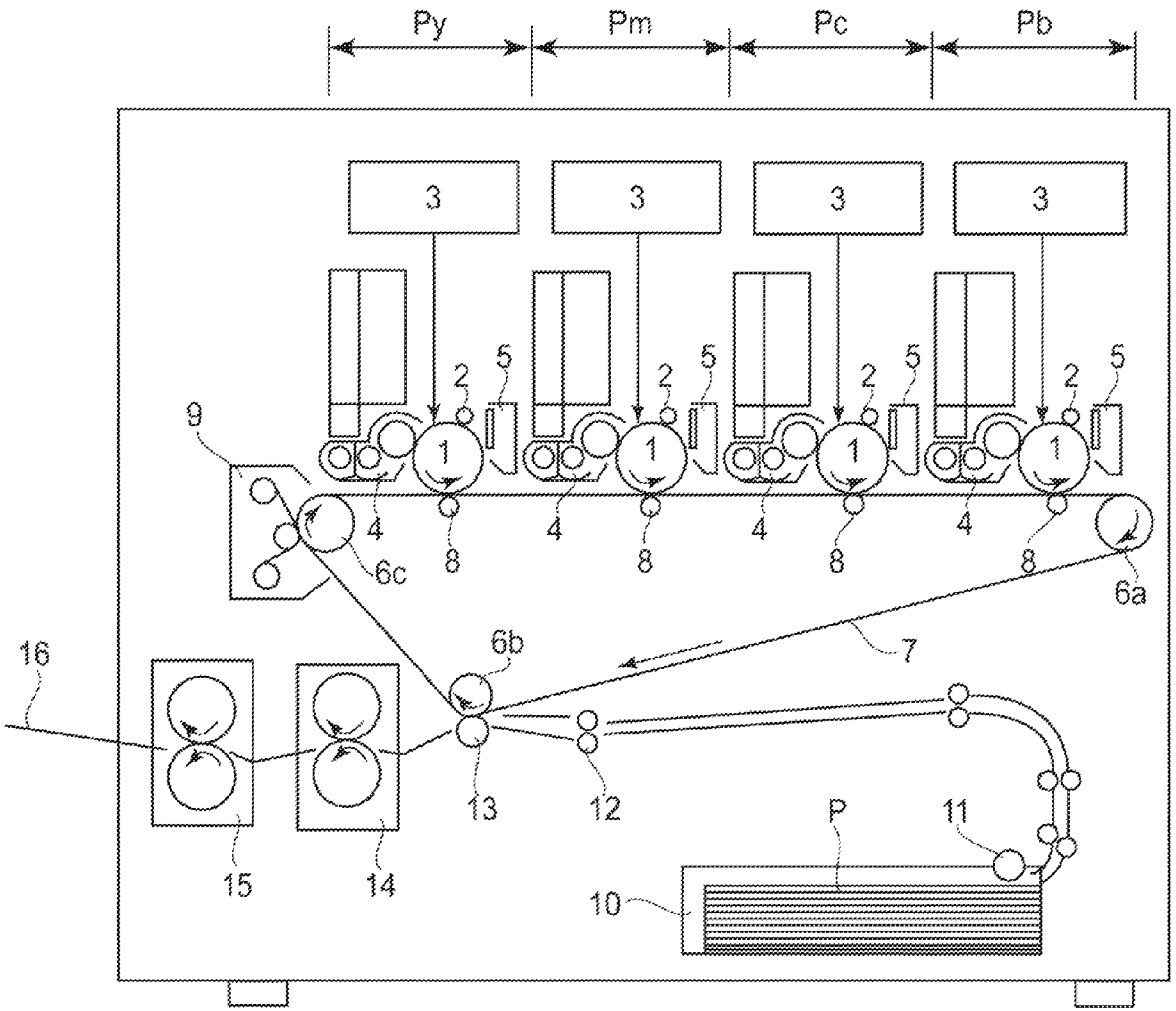
FIG. 1 is a schematic sectional view of an example of an image forming apparatus to which the present invention is applicable, at a plane perpendicular to the axial line of each of the photosensitive drums of the apparatus.

FIG. 1 is a schematic sectional view of an example of an image forming apparatus having an image heating apparatus in accordance with the present invention, at a plane perpendicular to the axial line of each of the photosensitive drums of the apparatus. This image forming apparatus is an electrophotographic color printer.

The structure of the image forming apparatus in this embodiment is such that four monochromatic toner images, different in color, are formed through charging, exposing, developing, and transferring processes carried out by the first, second, third, and fourth image forming portions Py, Pm, Pc, and Pb, respectively, which are in the main assembly of the apparatus and are in alignment in parallel in the recording medium conveyance direction.

The image forming apparatus in this embodiment starts a preset image forming operation sequence in response to a print command outputted from an external apparatus (unshown) such as a host computer. As the sequence is started, the image forming portions Py, Pm, Pc, and Pb sequentially begin to be driven, whereby the photosensitive drum 1 (image bearing member) of each image forming portion is rotated in the direction indicated by arrow marks at a preset peripheral velocity (process speed). The intermediary transfer belt 7 of the apparatus, which is supported and stretched by a driver roller 6*a*, a follower roller 6*b*, and a tension roller 6*c* of the apparatus, in such a manner that it remains in contact with the photosensitive drum 1 of each of the image forming portions Py, Pm, Pc, and Pb, is circularly moved by the driver roller 6*a* in the direction indicated by another arrow mark at a velocity which matches the peripheral velocity of each photosensitive drum 1.

Referring to the image forming portion Py, that is, the image forming portion for forming a monochromatic image of a yellow color (first color), the peripheral surface of the photosensitive drum 1 is uniformly charged by a charging device 2 to a preset polarity and potential level. Then, the uniformly charged portion of the peripheral surface of the photosensitive drum 1 is scanned (exposed) by the beam of laser light outputted from an exposing apparatus while being modulated in accordance with information of an image to be formed, whereby an electrostatic latent image, which reflects the information of the image to be formed, is effected on the peripheral surface of the photosensitive drum 1. This latent image is developed by the developing apparatus 4 which uses yellow toner (developer). That is, a visible image of yellow color is formed on the peripheral surface of the photosensitive drum 1. The steps similar to those carried out in the image forming portion Py are carried out also in the image forming portions Pm, Pc, and Pb, which are for forming monochromatic images of magenta color (second color), cyan color (third color), and black color (fourth color), respectively. As four toner images, different in color, are formed in the four image forming portions Py, Pm, Pc, and Pb, one for one, they are sequentially transferred in layers onto the outward surface of the intermediary transfer belt 7 by the first transfer rollers 8, each of which is kept pressed against the peripheral surface of the corresponding photosensitive drum 1 with the presence of the intermediary transfer belt 7 between itself and peripheral surface of the photosensitive drum 1.

Meanwhile, a sheet P of a recording medium is moved out of a sheet feeder cassette 10 by a sheet feeder roller 11, and then, is conveyed to a pair of registration roller 12. Then, the sheet P is conveyed by the pair of registration roller 12 to the second transfer nip, which is the interface between the intermediary transfer belt 7 and second transfer roller 13 (second transferring member). Then, the sheet P is conveyed through the second transfer nip while remaining pinched by the intermediary transfer belt 7 and the second transfer roller 13. While the sheet P is conveyed through the nip, the full-color toner image, that is, the combination of the four layers of monochromatic toner images, different in color, on the intermediary transfer belt 7, is transferred onto the surface of the sheet P by the second transfer roller 13. That is, an unfixed full-color toner image is borne on the surface of the sheet P. Then, the sheet P is introduced into the first fixing device 14, which is the image heating upstream unit in terms of the recording medium conveyance direction, and then, is introduced into the second fixing device 14, which is the image heating downstream unit. While the sheet P is conveyed through the first and second fixing devices 14 and 15, the unfixed toner image on the sheet P becomes fixed to the surface of the sheet P. Then, as the sheet P comes out of the second fixing device 15, it is discharged into the delivery tray 16, which is outside the main assembly of the image forming apparatus.

The toner remaining on the peripheral surface of the photosensitive drum 1 after the transfer (first transfer) of the toner image from the peripheral surface of the photosensitive drum 1 onto intermediary transfer belt 7 is removed by the drum cleaner 5, so that the peripheral surface of the photosensitive drum 1 can be used for the next image formation. The toner remaining on the intermediary transfer belt 7 after the transfer of the full-color toner image from the intermediary transfer belt 7 onto the sheet P, is removed by the belt cleaner 9 so that the portion of the intermediary transfer belt 7, from which the residual toner has just been removed, can be used for the next image formation.

(2) Description of First and Second Fixing Devices

In the following description of the first and second fixing devices, the "lengthwise and widthwise" directions of any of the components of which the first and second fixing devices are made mean the directions perpendicular and parallel, respectively, to the recording medium conveyance direction. The "width" of any component means the measurement of the component in terms of the widthwise direction. The "lengthwise and widthwise" directions of a sheet of a recording medium which is being conveyed through the fixing apparatus mean the directions perpendicular and parallel, respectively, to the recording medium conveyance direction. The "width" of a sheet of recording medium in the fixing apparatus means the measurement of the sheet in terms of the widthwise direction.

Figure 2:
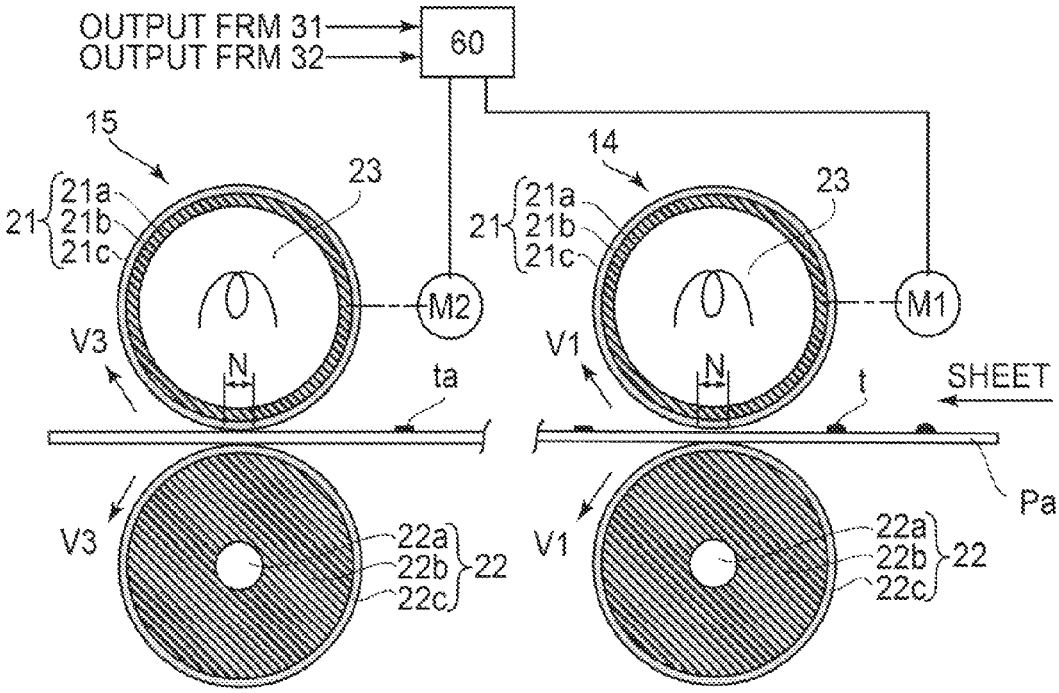
FIG. 2 is a schematic sectional view of the first and second fixing devices of the fixing apparatus in the first preferred embodiment of the present invention, at a plane perpendicular to the axial line of each of the four rollers of the fixing apparatus.

FIG. 2 is a schematic sectional view of the combination of the first and second fixing devices of the fixing apparatus (image heating apparatus) of the so-called tandem type, which is in the image forming apparatus, in this embodiment (first preferred embodiment), at a plane perpendicular to the lengthwise direction of both fixing devices.

Both the first and second fixing devices 14 and 15, respectively, in this embodiment are of the so-called heat roller type. That is, the first fixing device 14 has a fixation roller 21 (rotational heating member), a pressure roller 22 (rotational pressing member), a halogen heater 23 (heat generating member), etc. The lengthwise direction of each of the fixation roller 21, the pressure roller 22, and the halogen heater 23 (heat generating member) is parallel to the above-mentioned "lengthwise" direction. The fixation roller 21 is 30 mm in diameter. It is made up of a cylindrical metallic core 21*a* and an elastic layer 21*b*. The cylindrical metallic core 21*a* is made of iron. The elastic layer 21*b* is formed of silicone rubber, and is 1.0 mm in thickness. It covers the entirety of the peripheral surface of the metallic core 21*a*. The fixation roller 21 has also a parting layer 21*c*, which is formed of a piece of PFA tube. It is 30 μm in thickness, and covers the entirety of the elastic layer 21*b*. In the case of a fixing device to be mounted in a color image forming apparatus, the parting layer 21*c* of the fixation roller 21 may be formed of silicone rubber impregnated with silicone oil, instead of being formed of the piece of PFA tube. The pressure roller 22 is under the fixation roller 21, and is in parallel to the fixation roller 21. It is 30 mm in diameter. It is made up of a metallic core 22*a* and an elastic layer 22*b*. The metallic core 22*a* is in the form of a piece of an iron rod which is 10 mm in diameter. The elastic layer 22*b* is made of sponge, more specifically, foamed silicone rubber, and covers the entirety of the peripheral surface of the metallic core 22*a*. The pressure roller 22 also has a parting layer 22*c*, which is 30 μm in thickness. The parting layer 22*c* is a piece of PFA tube, and covers the entirety of the peripheral surface of the elastic layer 22*b*. The fixation roller 21 and the pressure roller 22 are rotatably supported by the frame (unshown) of the fixing apparatus, at their lengthwise ends of their metallic cores 21*a* and 22*a*, respectively, with the placement of a pair of bearings between the lengthwise ends of the metallic cores 21*a* and 22*a*, and the frame of the fixing apparatus. Further, the bearings for the pressure roller 22 are under the pressure generated by pressure applying members (unshown), such as compression springs, which keep the pressure roller 22 biased in the direction (toward) perpendicular to the generatrix of the fixation roller 21. The overall amount of the pressure applied to the bearings is roughly 392 N (40 kgf). Therefore, the elastic layer 22*b* of the pressure roller 22 and the elastic layer 21*b* of fixation roller 21 remain deformed across the portion at which they are in contact with each other. Thus, there is a nip N between the peripheral surface of the fixation roller 21 and the peripheral surface of the pressure roller 22. The nip N has a preset width. The halogen heater 23 is in the hollow of the metallic core 21*a* of the fixation roller 21. It is supported by the frame of the fixing apparatus, at its metallic contacts which are at its lengthwise ends. The second fixing device 15 is the same in structure as the first fixing device 14. In this embodiment, the components, members, etc., of the second fixing device 15, which are the same as their counterparts of the fixing device 14, are given the same reference characters as those given to their counterparts, and are not described to avoid a repetition of the same descriptions. The distance between the nip N of the first fixing apparatus 14 and that of the second fixing apparatus 15 is less than the length of a largest sheet Pa of the recording medium (which is preset in size, and will be referred hereafter as a large sheet Pa of a recording medium, or simply as large sheet Pa, among various sheets of recording media, different in size, usable by the image forming apparatus in this embodiment). Therefore, when the leading edge portion of a large sheet Pa of a recording medium is conveyed through the nip N of the second fixing device 15, remaining pinched between the fixation roller 21 and the pressure roller 22 of the second fixing device 15, while the sheet P is conveyed through the fixing apparatus to thermally fix the unfixed toner image t on the sheet Pa, the trailing edge portion of the sheet Pa is still in the nip N of the first fixing device 14, remaining pinched between the fixation roller 21 and the pressure roller 22 of the first fixing device 14.

(3) Thermal Fixing Operation of First and Second Fixing Devices

As a control portion 60 (controlling means), which is made up of a CPU, and memories such as a ROM and a RAM, receives a print command, it begins to drive a first fixation motor M1 (driving means) and a second fixation motor M2 (driving means) roughly at the same time in response to the print command, while carrying out a preset control for keeping the second fixation motor M2 slower in rotational speed than the first fixation motor M1. More specifically, as the first fixation motor M1 is driven, the rotation of its output shaft is transmitted to the fixation roller 21 of the first fixing device 14 through a speed reduction gear train (unshown), whereby the fixation roller 21 is rotated at a rotational speed V1 in the direction indicated by an arrow mark. Further, as the second fixation motor M2 is driven, the rotation of its output shaft is transmitted to the fixation roller 21 of the second fixing device 15 through a speed reduction gear train (unshown), whereby the fixation roller 21 is rotated in the direction indicated by an arrow mark at a rotational speed V3, which is slower than the rotational speed V1 of the fixation roller 21 of the first fixing device 14. The rotation of the fixation roller 21 of the first fixing device 14 is transmitted to the pressure roller 22 of the first fixing device 14 through the nip N between the two rollers 21 and 22. The rotation of the fixation roller 21 of the second fixing device 15 is transmitted to the pressure roller 22 of the second fixing device 15 through the nip N between the two rollers 21 and 22. Thus, the two pressure rollers 22 are rotated by the corresponding fixation rollers 21 at the same rotational speeds as the rotational speeds V1 and V3, respectively, in the direction indicated by arrow marks. Hereafter, the rotational speed of the fixation roller 21 of the first fixing device 14, and that of the pressure roller 22 of the first fixing device 14, are referred to as the recording medium conveyance speed of the first fixing device 14, whereas the rotational speed of the fixation roller 21 of the second fixing device 15, and that of the pressure roller 22 of the second fixing device 15, are referred to as the recording medium conveyance speed of the second fixing device 15. The halogen heater 23 is supplied with a preset amount of electric power by a power supply control portion (unshown). As it is turned on, it generates heat. As heat is generated by the halogen heater 23, the metallic core 21*a* of the fixation roller 21 is heated from within. As the fixation roller 21 is heated, its surface temperature is detected by a temperature detecting member (unshown) such as a thermistor located in the adjacencies of the peripheral surface of the fixation roller 21. The output signals from the temperature detecting member are taken in by the control portion 60, which controls the power supply control portion in response to the output signals from the temperature detecting member, in such a manner that the surface temperature of the fixation roller 21 remains at a preset fixation level (target level). In this embodiment, the fixation temperature level (target temperature level) is 170° C.

While the first and second fixation motors M1 and M2, respectively, are being driven, and the halogen heaters 23 are being supplied with electric power, a large sheet Pa of a recording medium, on which an unfixed toner image t is present, is introduced into the nip N of the first fixing device 14, and is conveyed through the nip N, remaining pinched by the peripheral surface of the fixation roller 21 and the peripheral surface of the pressure roller 22. While the sheet Pa is conveyed through the nip N of the first fixing device 14, the toner image t on the sheet Pa is heated by the heat from the fixation roller 21 while being pressed by the pressure in the nip N. Thus, the toner image t, which is made of the four monochromatic images, more specifically, yellow, magenta, cyan, and black monochromatic images, are melted, becoming thereby mixed. Then, as they cool down, they become fixed to the surface of the sheet Pa. As they cool down, the texture (glossiness) of the peripheral surface of the fixation roller 21 is transferred onto the surface of the cooling mixture of the toner images. Thus, as the mixture of the toner images cools down, it results in a full-color image, the surface of which reflects the glossiness (texture) of the peripheral surface of the fixation roller 21 of the first fixing device 14. As the toner image t is being fixed to the large sheet Pa of the recording medium in the nip N of the first fixing device 14, the sheet Pa is conveyed out of the nip N from its leading edge side, that is, the side from which it was introduced into the nip N. Then, it is introduced into the nip N of the second fixing device 15, and is conveyed through the nip N thereof while remaining pinched by the peripheral surface of the fixation roller 21 and pressure roller 22 of the second fixing device 15. While the sheet Pa is conveyed through the nip N of the second fixing device 15, the fixed toner image ta on the surface of the large sheet Pa of recording medium is subjected to the heat from the fixation roller 21 and the pressure in the nip N of the second fixing device 15. As the fixed toner image ta is subjected to the heat from the fixation roller 21, it is softened by the heat. Then, as the softened toner images ta cools down, the texture (glossiness) of the peripheral surface of the fixation roller 22 is transferred onto the surface of the toner image ta by the pressure in the nip N. Thus, after the softened toner image ta cools down, the glossiness of the toner image ta reflects the glossiness of the peripheral surface of the fixation roller 21 of the second fixing device 15. Then, the large sheet Pa of the recording medium is discharged from the fixing device 15 while the surface of the toner images ta thereon is made glossier by the peripheral surface of the fixation roller 21 of the second fixing device 15 than it was before the sheet Pa was introduced into the second fixing device 15.

Figure 3:
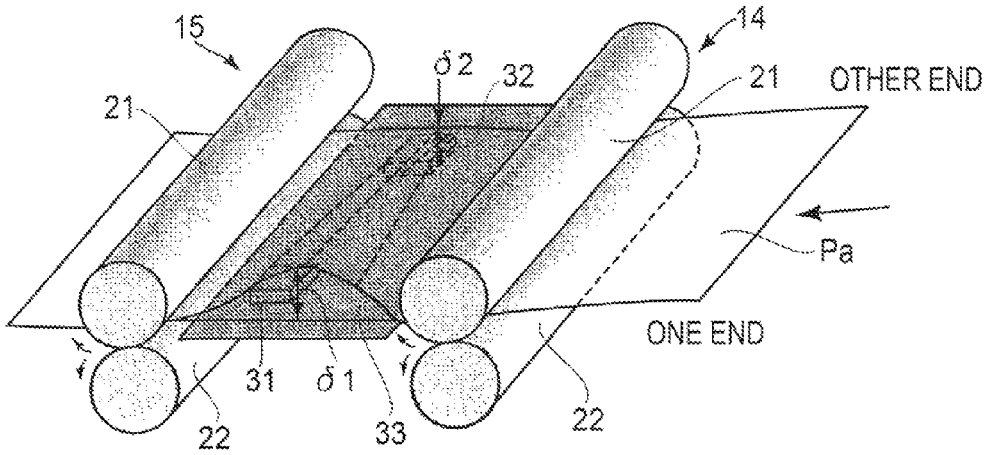
FIG. 3 is a schematic perspective view of the first and second fixing devices of the fixing apparatus in the first preferred embodiment of the present invention, and shows the positioning of the slack amount sensors which detect the amount of the slack of a large sheet of recording medium as the sheet becomes slackened between the nip of the first fixing device of the fixing apparatus in the first embodiment, and the nip of the second fixing device of the fixing apparatus while the sheet is conveyed through the fixing apparatus.

(4) Structural Arrangement for Prevention of Image Deterioration on Large Sheet of Recording Medium in Nip N in Second Fixing Device FIG. 3 is a schematic perspective view of the fixing apparatus, and shows the location of the sensor for detecting the amount of the slack which occurs to a large sheet Pa of a recording medium between the first and second fixing devices, while the sheet Pa is conveyed through the fixing apparatus. It sometimes occurs that while a large sheet Pa of a recording medium is conveyed through the fixing apparatus, in particular, when the leading edge portion of the sheet Pa is in the nip N of the second fixing device 15 and the trailing edge portion of the sheet Pa is still in the nip N of the first fixing device 14, the nips N become different in the recording medium conveyance speed (nip N of second fixing device becomes slower in the recording medium conveyance speed than nip N of first fixing device), and the large sheet Pa begins to become slack toward its image bearing surface. If the two nips N become non-uniform in the recording medium conveyance speed in terms of the widthwise direction of the large sheet Pa, the amount of slack at the portions δ1 and δ2 of the slackened portion of the large sheet Pa, which correspond in position to one of the widthwise edges of the large sheet Pa and the other widthwise edge thereof, respectively, become different. Further, the greater the speed with which the sheet Pa is conveyed, the greater the difference in the amount of slack between the portions δ1 and δ2 of the slackened portion of the large sheet Pa. Thus, it is possible that the image bearing surface of the larger of the slackened portion δ1 or δ2 will come into contact with the peripheral surface of the fixation roller 21 of the first fixing device 14 and/or the peripheral surface of the fixation roller 21 of the second fixing device 15, and therefore, the toner image on the sheet Pa will be damaged, more specifically, scratched and/or dislodged. Here, a "slackened" portion means the portion of the sheet Pa, which has curved toward the image bearing surface of the sheet Pa between the nip N of the first fixing device 14 and the nip N of the second fixing device 15.

In this embodiment, therefore, in order to detect the amount of the slack of each of the portions δ1 and δ2 of the slackened portion of the large sheet Pa of recording medium, the fixing apparatus is provided with a pair of slack amount sensors 31 and 32, which are placed so that they are on the opposite side of the sheet Pa from the image bearing surface, and also, so that they are on the inward side of the recording medium sheet passage in terms of the widthwise direction of the sheet Pa when the sheet Pa is conveyed through the fixing apparatus. Thus, the amount of the slack of the portion δ1, which corresponds in position to one of the widthwise edges of the sheet Pa, is detected by the slack amount sensor 31, whereas the amount of the slack of the portion δ2, which corresponds in position to the other widthwise edge of the sheet Pa is detected by the slack amount sensor 32. The slack amount sensors 31 and 32 are on a sensor supporting member 33. In terms of the recording medium conveyance direction, the sensor supporting member 33 (and the slack amount sensors 31 and 32) is between the first and second fixing devices 14 and 15. In terms of the direction perpendicular to the recording medium conveyance direction, the slack amount sensor supporting member 32 is located so that when the large sheet Pa of the recording medium is conveyed between the first and second fixing devices 14 and 15, it will be on the opposite side from the image bearing surface of the sheet Pa. The slack amount sensors 31 and 32 in this embodiment are such sensors that project a beam of light upon the widthwise end portions of the opposite surface of the large sheet Pa of recording medium from the image bearing surface, and outputs electrical signals, the levels of which correspond to the points of the sheet Pa from which the beam of light from each of the sensors 31 and 32 is reflected. That is, the slack amount sensors 31 and 32 output electrical signals, the level of which corresponds to the amount of the slack of the portions δ1 and δ2, respectively, of the slackened portion of the large sheet Pa of recording medium.

Figure 4:
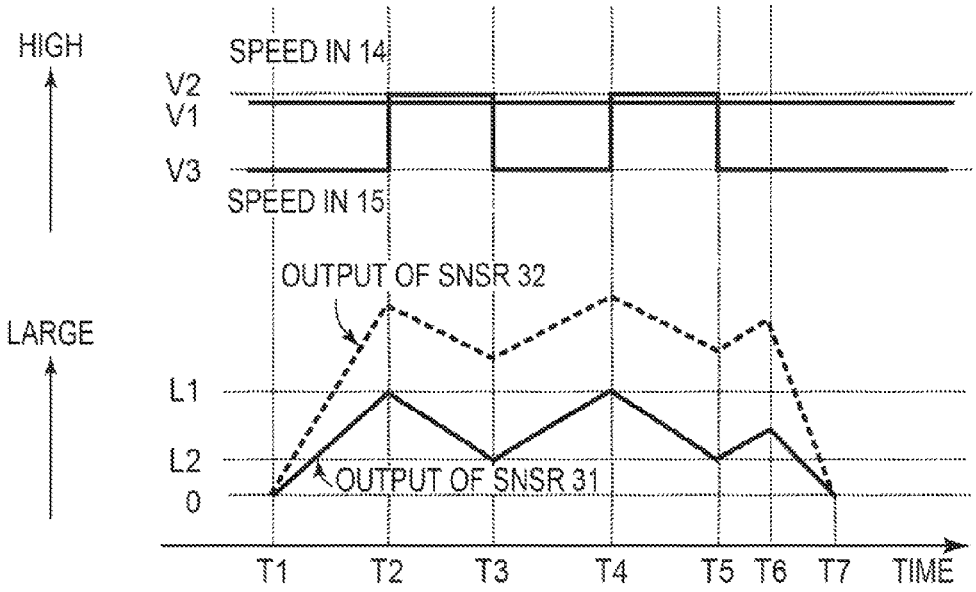
FIG. 4 is a graph which shows the relationship between the output of the slack amount sensors for detecting the amount of the slack of a sheet of recording medium, on one side of the fixing apparatus in terms of the lengthwise direction of the fixing apparatus and on the other side, and the recording medium conveyance speed of the first and second fixing devices.

Referring to FIG. 3, described next is an example of an operation in which if the amount of slack at the portion δ1 of the slackened portion of the large sheet Pa of recording medium becomes different than the amount of slack at the portion δ2 of the slackened portion of the sheet Pa, the second fixing device 15 is changed in the recording medium conveyance speed by controlling the driving of the second fixation motor M2. FIG. 4 is a graph which shows the relationship between the outputs of the two slack amount sensors 31 and 32 which correspond in position to the widthwise ends of the sheet Pa in the fixing apparatus in this embodiment, and the recording medium conveyance speeds of the first and second fixing devices, respectively. Point 0 on a vertical line (T1), which stands for the elapsed time in FIG. 4, corresponds to the point in time at which the leading edge of the large sheet Pa of the recording medium was introduced into the nip N of the second fixing device 15, whereas point 0 on a vertical line (T7) corresponds to the point in time at which the trailing edge of the sheet Pa is discharged from the nip N of the second fixing device 15. Points 0 which correspond to the elapsed lengths (T1) and (T7) of time, one for one, are reset each time a large sheet Pa of the recording medium is conveyed through the second fixing device 15.

Referring to FIG. 4, it is assumed that a large sheet Pa of the recording medium begins to be conveyed through the second fixing device 15 (T1) while remaining pinched in the nip N. While the large sheet Pa is conveyed through the nip N, the portions δ1 and δ2 of the slackened portion the large sheet Pa, which correspond in position to the widthwise end portions, one for one, increase in the amount of slack, increasing thereby the output strength of signals output from the slack amount sensors 31 and 32 (T1-T2). Then, as the smaller of the output from the slack amount sensor 31 and the output from the slackness sensor 32 reaches a preset slack amount control start level L1 (T2), the second fixing device is changed in the recording medium conveyance speed from V3 to a preset recording medium conveyance speed V2, which is greater than the recoding medium conveyance speed V1 of the first fixing device 14 (V2>V1>V3). Here, the slack amount control start level L1 is a level preset for the smaller of the outputs of the slack amount sensor 31 and 32, one for one, above which the amount of slack of the large sheet Pa of the recording medium is controlled to prevent the larger of the portions δ1 and δ2 of the slackened portion of the large sheet Pa from coming into contact with the peripheral surface of the fixation roller 21. As the second fixing device 15 is increased in the recording medium conveyance speed from V3 to V2, the amounts of slack in the portions δ1 and δ2 of the slackened portion of the large sheet Pa begin to decrease, and therefore, the outputs of the slack amount sensors 31 and 32 weaken (T2-T3). Then, as the output of the weaker of the slack amount sensors 31 and 32 in terms of output strength reaches a preset slack amount control start level L2 (T3), the recording medium conveyance speed of the second fixing device 15 is reduced from V2 to V3, which is the original recording medium conveyance speed. Here, the slack amount control start level L2 means the slack amount level above which the amount of slack of the large sheet Pa of the recording medium is controlled to prevent the smaller of the portions δ1 and δ2 of the slackened portion of the large sheet Pa from being excessively pulled by the second fixing device 15, whose recording medium conveyance speed is V2. As the recording medium conveyance speed of the second fixing device 15 is reduced from V2 to V3, the amounts of slack of the portions δ1 and δ2 of the slackened portion of the large sheet Pa begin to increase, and therefore, the outputs of the slack amount sensors 31 and 32 become stronger (T3-T4). The above-described steps are repeated until the trailing edge of the large sheet Pa of recording medium is discharged from the nip N of the second fixing device 15.

Figure 5:
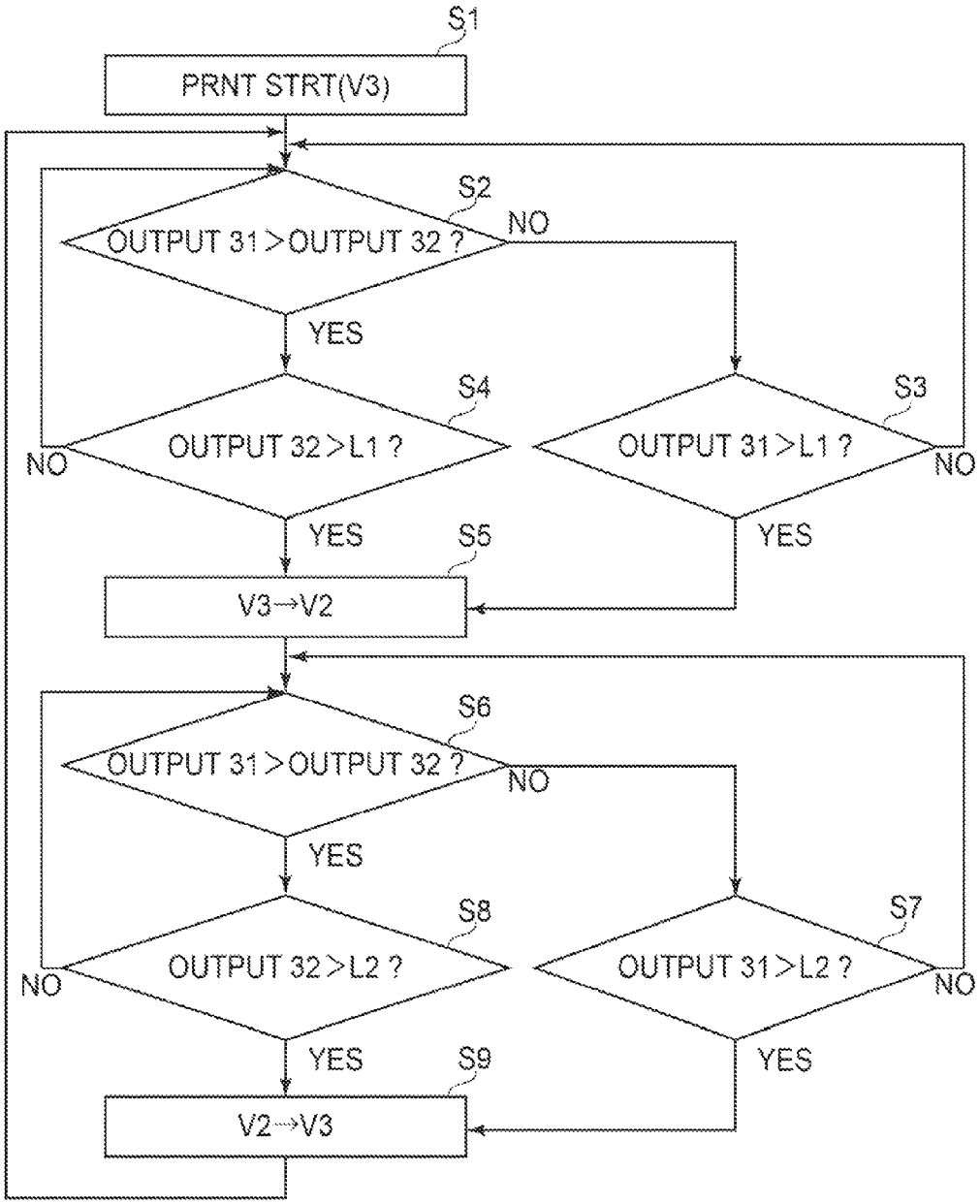
FIG. 5 is an example of a control sequence for changing the second fixing devices in the recording medium conveyance speed.

Next, referring to FIG. 5, the control sequence through which the recording material conveyance speed of the second fixing device 15 is changed by the control portion 60 is described. FIG. 5 is an example of a flowchart of the control sequence through which the recording material conveyance speed of the second fixing device 15 is changed by the control portion 60. As a printing operation is started, the recording material conveyance speed of the second fixing device 15 is started at V3 (S1). In step (S2), it is determined whether or not the output of the slack amount sensor 31 is greater than the output of the slack amount sensor 32. If the output of the slack amount sensor 31 is greater than the output of the slack amount sensor 32 (Y), the control portion 60 proceeds to step (S4), whereas if the former is less than the latter (N), the control 60 proceeds to (S3). In step (S3), it is determined whether or not the output of the slack amount sensor 31 is greater than the slack amount control start level L1. If the output of the slack amount sensor 31 is greater than slackness amount control start value L1 (Y), the control portion 60 proceeds to step (S5), whereas if the output of the slack amount sensor 31 is less than the slackness amount control start value L2 (N), the control portion 60 returns to step (S2). In step (S4), the control determines whether or not the output of the slack amount sensor 32 is greater than the slack amount control start level L1. If the output of the slack amount sensor 32 is greater than the slack amount control start level L1 (Y), the control portion 60 proceeds to step (S5), whereas if the output of the slack amount sensor 32 is less than the slack amount control start level L1 (N), the control portion 60 returns to step (S2). In step (S5), a preset control is carried out to increase the rotational speed of the second fixation motor M2 so that the recording medium conveyance speed of the second fixing device 15 is increased to V2. In other words, the recording medium conveyance speed of the second fixing device 15 is changed from V3 to V2. In step (S6), the control portion 60 determines whether or not the output of the slack amount sensor 31 is larger than the output of the slackness sensor 32. If the output of the slack amount sensor 31 is larger than the output of the slack amount sensor 32 (Y), the control portion 60 proceeds to step (S8). If the output of the slack amount sensor 31 is smaller than the output of the slack amount sensor 32 (N), the control portion proceeds to a step (S7). In the step (S7), the control portion 60 determines whether or not the output of the slack amount sensor 31 is greater than the slack amount control start level L2. If the output of the slack amount sensor 31 is larger than the slack amount control start level L2 (Y), the control portion 60 advances to a step (S9). If the output of the slack amount sensor 31 is smaller than the slack amount control start level L2 (N), the control portion 60 returns to the step (S6). In a step (S8), the control portion 60 determines whether or not the output of the slack amount sensor 32 is larger than the slack amount control start level L2. If the output of the slack amount sensor 32 is larger than the slack amount control start level L2 (Y), the control portion 60 proceeds to the step (S9). If the output of the slack amount sensor 32 is smaller than the slack amount control start level L2 (N), the control portion 60 returns to the step (S6). In the step (S9), the control portion 60 carries out a preset control sequence to reduce the rotational speed of the second fixation motor M2 so that the recording medium conveyance speed of the second fixing device 15 is reduced from V2 to V3. Thus, the recording medium conveyance speed of the second fixing device 15 is changed from V2 to V3.

Figure 6:
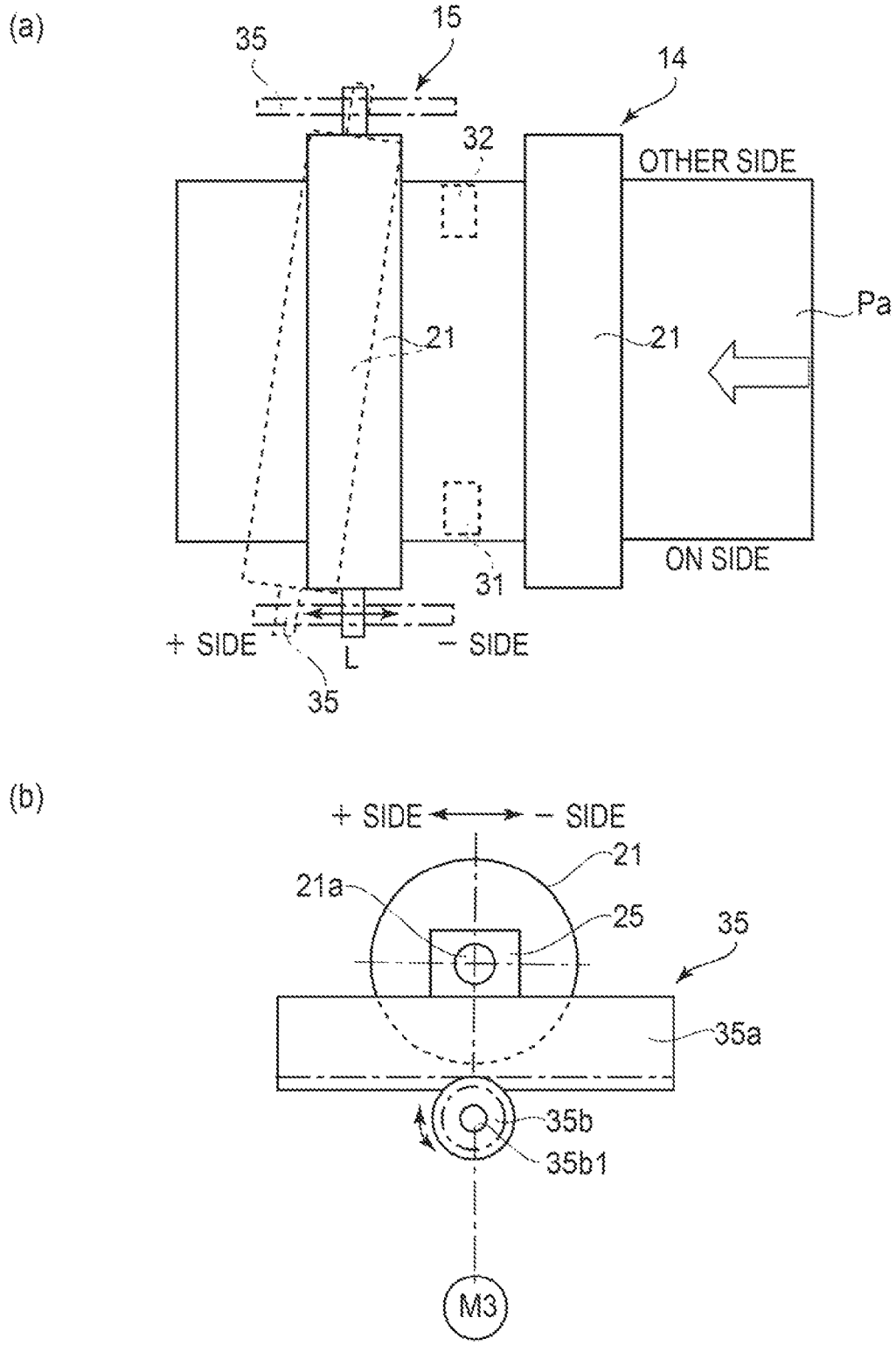
FIG. 6(*a*) is a top plan view of the second fixing device of the fixing apparatus in the first preferred embodiment, as seen from above the fixation roller.

Next, a shifting mechanism 35, in this embodiment, for adjusting in the fixing apparatus the distance between one of the lengthwise ends of the first fixing device 14 and the corresponding lengthwise end of the second fixing device 15, and also, the distance between the other lengthwise end of the first fixing device 14 and the corresponding lengthwise end of the second fixing device, before the starting of the above-described sequence for changing the recording medium conveyance speed of the first and second fixing devices is described. In this embodiment, the attitude (angle) of the fixation roller 21 of the first fixing device is not changeable, but, the attitude (angle) of the fixation roller 21 of the second fixing device is changeable. The shifting mechanism 35 is made up of a rack and a pinion gear, for example. Referring to FIG. 6(*b*), designated by a reference numeral 25 is a bearing, which is at each of the lengthwise ends of the metallic core 21*a* of the fixation roller 21. The bearings 25 are supported by the aforementioned frame in such a manner that they can be moved upstream and downstream in terms of the recording medium conveyance direction. The shifting mechanism 35 is at each of the lengthwise ends of the fixation roller 21. It has: a rack 35*a*, which is under the bearing 25; a pinion gear 35*b* which is in meshing engagement with the rack 35*a*; and a shift motor M3 (driving means) for rotating the pinion gear 35*b*.

Figure 7:
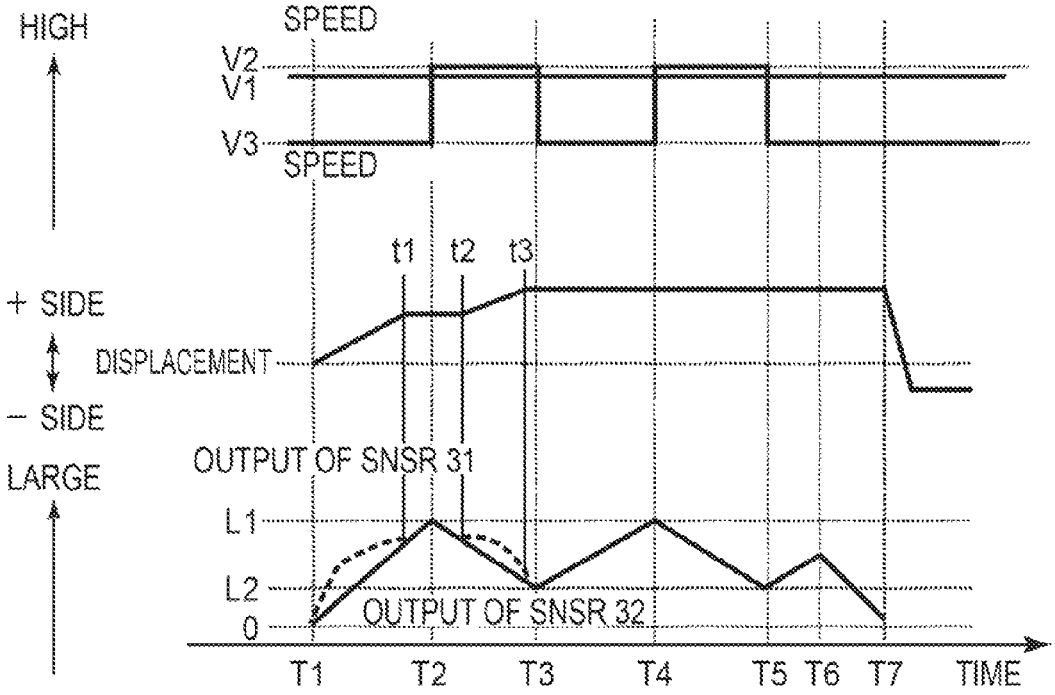
FIG. 7 is a graph which shows the relationship between the output of the slack amount sensors for detecting the amount of the slack of a sheet of the recording medium, on one side of the fixing apparatus in terms of the lengthwise direction of the fixing apparatus and on the other side, and the recording medium conveyance speed of the first and second fixing devices.
Figure 8:
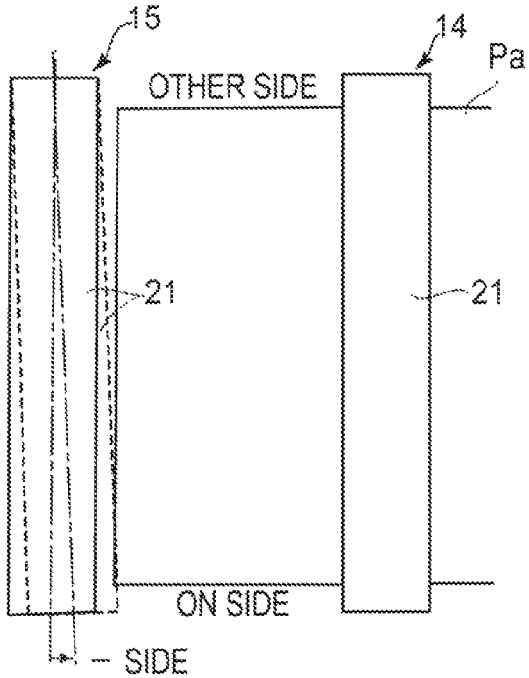
FIG. 8 is a schematic top plan view of the fixing apparatus, in the first embodiment, the fixation roller of the second fixing device of which is tilted upstream relative to the recording medium conveyance direction.

Referring to FIGS. 6-8, the control sequence to be carried out by the control portion 60 to change the recording medium conveyance speed of the second fixing device 15 when the amount of slack of either of the portions δ1 and δ2 of the slackened portion of the large sheet Pa of the recording medium, which correspond in position to the widthwise direction of the sheet Pa, is greater than the amount of slack of the other, is described along with the operation of the shifting mechanism 35. FIG. 7 is a graph which shows the relationships among: the output of each of the slack amount sensors 31 and 32, which correspond in location to the widthwise end portions of the large size sheet Pa of the recording medium while the sheet Pa is conveyed through the fixing apparatus, and the amount by which the fixation roller 21 of the second fixing device 14 is changed in attitude (angle); the recording medium conveyance speed of the first fixing device 14; and the recording medium conveyance speed of the second fixing device 15.

Next, first, referring to FIG. 7, the operation carried out when the fixing apparatus is in a correction mode is described. The portion of the image forming apparatus, by which the fixing apparatus is operated in the correction mode is the control portion 60. In this embodiment, it is the second fixing device 15 that is adjusted first. More specifically, first, the attitude (angle) of the fixation roller 22 of the second fixing device 15 is adjusted, and then, the recording medium conveyance speed is adjusted.

Referring to FIG. 7, as a large sheet Pa of the recording medium begins to be conveyed through the nip N of the second fixing device 15 by being pinched in the nip N (T1), the slackness of the large sheet Pa begins to increase across both the widthwise end portions, whereby outputs of the slack amount sensors 31 and 32 also increase (T1-T2). As the control portion 60 detects, based on the outputs of the slack amount sensors 31 and 32, that the amount of slack of either portion δ1 or δ2 of the slackened portion of the large sheet Pa, which correspond in position to the widthwise end portions of the large sheet Pa, is greater than the amount of slack of the other, the control portion 60 drives forward the shift motor M3, which corresponds to the larger of the portions δ1 and δ2 in terms of the amount of slack, for example, the portion δ1. Thus, the output shaft of the shift motor M3 rotates, and the rotation of the output shaft is transmitted to the supporting shaft 35*b*1 of the pinion gear 35*b*. Therefore, the pinion gear 35*b* rotates, whereby the rack 35*a* is moved downstream in terms of the recording medium conveyance direction. As the rack 35*a* is moved, the bearing 25 is displaced downstream (+ direction in FIG. 6(*a*)). This displacement of the bearing 25 causes the fixation roller 21 to tilt so that the corresponding lengthwise end of the fixation roller 21 moves in the + direction, in the plane parallel to the large sheet Pa which is being conveyed.

Thus, the corresponding side of the large sheet Pa is pulled in the + direction by the corresponding side of the fixation roller 21. Therefore, the amount of slack of the portion δ1, for example, is gradually reduced until the outputs of the slack amount sensors 31 and 32 become equal, that is, until the amounts of slack of the portions δ1 and δ2 of the slackened portion of the large sheet Pa, which correspond in position to the lengthwise end portions of the large sheet Pa of the recording medium, one for one, become equal. As the amounts of slack of the two portions δ1 and δ2 become equal (t1), the control portion 60 stops driving the above-described shifting motor M3, which in turn stops the corresponding bearing 25 from shifting in the + direction. Thus, the fixation roller 21 stops being tilted as described above, and remains tilted at such an angle that its lengthwise end, which corresponds to the shifted bearing 25, is on the plus side as depicted with a broken line in FIG. 6(*a*).

Next, the control portion 60 adjusts the recording medium conveyance speed of the second fixing device 15. This sequence for adjusting the recording medium conveyance speed of the second fixing device 15 is carried out based on the flowchart shown in FIG. 5.

That is, as the output of the slack amount sensor 32 reaches the preset slack amount control start level L1 (T2), the control portion 60 changes the recording medium conveyance speed of the second fixing device 15 from V3 to V2, which is greater than the recording medium conveyance speed V1 of the first fixing device 14 (V2>V1>V3). As the recording medium conveyance speed of the second fixing device 15 is changed from V3 to V2, the amounts of slack of the portions δ1 and δ2 of the large sheet Pa of recording medium begins to be reduced, which in turn reduces the output of the slack amount sensor 32 (T2-T3). After the changing of the recording medium conveyance speed of the second fixing device 15 from V3 to V2, if the outputs of the slack amount sensors 31 and 32 become different (t2), the control portion 60 drives forward the shift motor M3, which corresponds in position to one of the widthwise ends of the large sheet Pa of the recording medium, so that the outputs of the slack amount sensors 31 and 32 become equal as described above. As the outputs of the slack amount sensors 31 and 32 become equal (t3), the control portion 60 stops driving the shift motor M3 to make the amounts of slack of the portions δ1 and δ2 of the slackened portion of the large sheet Pa, which correspond in position to the widthwise end portions of the large sheet Pa, one for one, the same. Then, as the output of the slack amount sensor 32 reaches the preset slack amount control start level L2 (T3), the control portion 60 changes the recording medium conveyance speed of the second fixing device 15 from V2 to V3. As the recording medium conveyance speed of the second fixing device 15 is reduced from V2 to V3, the amounts of slack in the portions δ1 and δ2 of the large sheet Pa begin to increase, causing the outputs of the slack amount sensors 31 and 32 to increase (T3-T4). The control portion 60 continuously repeats the above-described steps until the trailing edge of the large sheet Pa is discharged from the nip N of the second fixing device 15.

As soon as the trailing edge of the large sheet Pa of the recording medium comes out of the nip N of the second fixing device 15 (T7), the shift motor M3 of the second fixing device 15 is driven in reverse for a preset length of time, whereby the output shaft of the shift motor M3 rotates. This rotation of the output shaft of the shift motor M3 causes the pinion gear 35*b* to rotate, thereby causing the rack 35*a* to move upstream in terms of the recording medium conveyance direction, and stops. This movement of the rack 35*a* causes the bearing 25 to move upstream in terms of the recording medium conveyance direction (– direction in FIG. 6(*a*)), until the fixation roller 21 is tilted by a preset angle so that one of the lengthwise end of the fixation roller 21 moves in the – direction as depicted by a broken line in FIG. 8(*a*).

By the way, as one of the mechanical reasons why the slack of the portions δ1 and δ2 of the slackened portion of the large sheet Pa of the recording medium, which correspond in position to the widthwise end portion of the large sheet Pa, are different, the following is possible. That is, it is possible that the recording medium conveyance speed of the fixing devices 14 and 15 may not be uniform, in terms of their lengthwise direction, or that the fixation roller 21 and the pressure roller 22 of the first fixing device 14, and the fixation roller 21 and the pressure roller 22 of the second fixing device 15, may be, or may have become tilted relative to the direction perpendicular to the recording medium conveyance direction.

Thus, in order to reduce the amount of slack of the portion δ1 of the slackened portion of the large sheet Pa, which corresponds in position to one of the widthwise end portions of the large sheet Pa, the fixation roller 21 is tilted in the – direction by the same angle as that by which the fixation roller 21 is tilted in the +direction (so that lengthwise end of fixation roller 21 moves in – direction), and is kept at that angle. This arrangement makes it possible to introduce the leading side of the upstream edge of the large sheet Pa of the recording medium in terms of the recording medium conveyance direction, into the nip N of the second fixing device 15, before the trailing side of the upstream edge of the large sheet Pa. That is, by tilting the fixation roller 21 relative to the direction perpendicular to the recording medium conveyance direction, in the plane which coincides with the surface of the sheet Pa in the nip N, the distance of the fixation roller 21 of the second fixing device 15 from the fixation roller 21 of the first fixing device 14 can be reduced, and therefore, the amount by which the next large sheet Pa of the recording medium is slackened when the sheet Pa is conveyed between the nip N of the first fixing device and the nip N of the second fixing device is reduced. This in turn makes it possible to reduce the amount by which the bearing 25 has to be moved upstream to reduce the amount of slack of the portion δ1 (which will be slackened) of one of the widthwise end portions of the large sheet Pa. Thus, the leading side of the upstream edge of the large sheet Pa is introduced into the nip N of the second fixing device 15, and begins to be conveyed through the second fixing device 15, before the trailing side of the upstream edge of the large sheet Pa, as shown in FIG. 8. Therefore, it is possible to reduce the amount of the difference between the amount by which the portions δ1 and δ2 of the large sheet Pa, which correspond in position to the widthwise end portions of the large sheet Pa, one for one, are slackened between the first and second fixing devices 14 and 15.

Figure 9:
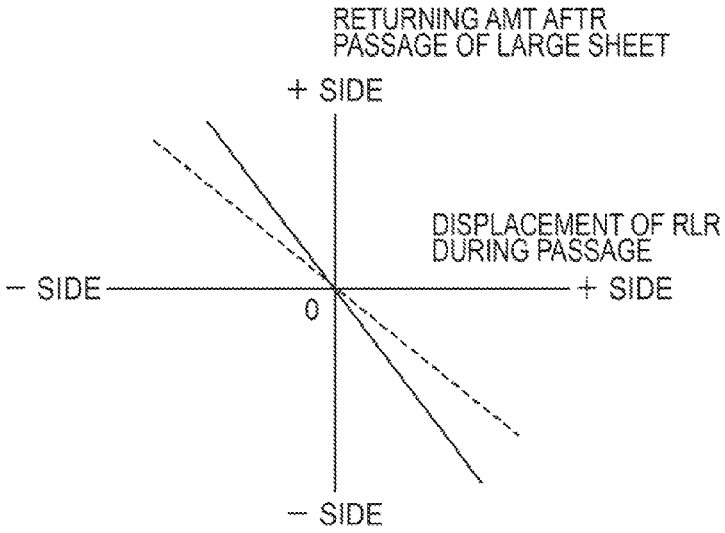
FIG. 9 is a graph which shows the relationship between the angle by which the fixation roller of the second fixing device of the fixing apparatus in the second preferred embodiment of the present invention was tilted and the angle by which the fixation roller is restored in attitude.

The relationship between the attitude (angle by which it is tilted) of the fixation roller 21 of the second fixing device 15 during the conveyance of a large sheet Pa of the recording medium through the second fixing device 15, and the attitude (angle) of the fixation roller 21 of the second fixing device 15 after the passage of the large sheet Pa through the second fixing device 15, is as shown in FIG. 9. The broken line represents the case in which the ratio between the amount by which the fixation roller 21 was tilted, and the amount by which the fixation roller 21 is reduced in angle was 1:1. In this embodiment, the design of the fixing apparatus is such that the greater the angle by which the fixation roller is tilted during the conveyance of the large sheet Pa through the second fixing device 15, the greater the angle by which the fixation roller 21 is tilted back after the passage of the large sheet Pa through the second fixing device 15, as indicated by the solid line. A point "0" in FIG. 9 corresponds to the point in time when the leading edge of the large sheet Pa was introduced into the nip N of the second fixing device 15, and was reset each time a large sheet Pa of recording medium was introduced into the second fixing device 15.

Also in the case of the fixing apparatus in this embodiment, if the amount of slack of one of the portions δ1 and δ2 of the slackened portion of the large sheet Pa of the recording medium, which correspond in position to the widthwise end portions of the large sheet Pa, one for one, in the fixing apparatus, is larger than the other, for example, the amount of slack of the portion δ2 is larger than the amount of slack of the portion δ1, the fixation roller 21 is tilted by a preset angle in the plane which coincides with the surface of the large sheet Pa in the second fixing device 15 so that its lengthwise end which corresponds to the portion δ2 is moved in the +direction. That is, the control portion 60 moves the rack 35*a* by a preset distance in the recording medium conveyance direction by rotating forward the shift motor M3, which corresponds in position to the portion (opposite portion of slackened portion of large sheet Pa from portion δ1), which happened to have a larger amount of slack than the portion δ1. Thus, the fixation roller 21 tilts by a preset angle so that the lengthwise end of the fixation roller 21 moves in the + direction. Then, as the output of the slack amount sensor 31 reaches the slack amount control start level L1, the control portion 60 changes the recording medium conveyance speed of the second fixing device 15 from V3 to the preset recording medium conveyance speed V2, which is greater than the recording medium conveyance speed V1 of the first fixing device 14 (V2>V1>V3). Further, after the recording medium conveyance speed of the second fixing device 15 is changed from V3 to V2, if the outputs of the slack amount sensors 31 and 32 become different, the control portion 60 drives forward the shift motor M3, which corresponds in position to the other widthwise end of the large sheet Pa of recording medium. Then, as the output of the slack amount sensor 31 reaches the preset slack amount control start level L2, the control portion 60 changes the recording medium conveyance speed of the second fixing device 15 from V2 to V3. The above-described operational sequence is continuously repeated by the control portion 60 until the trailing edge of the large sheet Pa is discharged from the nip N of the second fixing device 15.

As soon as the trailing edge of the large sheet Pa of the recording medium is conveyed out of the nip N of the second fixing device 15, the control portion 60 drives the shift motor M3 of the second fixing device 15 in reverse for a preset length of time, whereby the pinion gear 35*b* is rotated, thereby causing the rack 35*a* to move upstream in terms of the recording medium conveyance direction. Therefore, the fixation roller 21 is tilted by roughly the same angle as the angle by which it was tilted in the + direction, so that the other lengthwise end of the fixation roller 21 moves in the − direction. Thus, the other widthwise end of the following large sheet Pa of the recording medium is introduced into the nip N of the second fixing device 15 before the opposite widthwise end of the large sheet Pa, and the large sheet Pa begins to be conveyed through the second fixing device 15. Therefore, it becomes possible to reduce the difference between the amount by which the portions δ1 of the large sheet Pa is slackened between the first and second fixing devices 14 and 15, respectively, while the large sheet Pa is conveyed through the fixing apparatus, and the amount by which the portion δ2 of the large sheet Pa is slackened between the first and second fixing devices 14 and 15, respectively, while the large sheet Pa is conveyed through the fixing apparatus.

In this embodiment, the fixing apparatus is structured so that the fixation roller 21 of the second fixing device is tilted downstream in terms of the recording conveyance direction, in the plane which coincides with the surface of the sheet P of the recording medium in the fixing apparatus, so that the outputs of the two slack amount sensors 31 and 32 become equal. Thus, the fixing apparatus is adjusted in such a manner that when a large sheet Pa of the recording medium is conveyed through the fixing apparatus, the amount by which one side of the large sheet Pa in terms of the widthwise direction of the sheet Pa is slackened between the first and second fixing devices equals the amount by which the other side of the large sheet Pa is slackened between the first and second fixing devices. Further, as the amounts of slack of the two sides of the large sheet Pa in terms of the widthwise direction of the sheet Pa become equal, the recording medium conveyance speed of the second fixing device is increased or decreased relative to the recording medium conveyance speed of the first fixing device so that one or/and the other end of the slackened portion of the large sheet Pa does not come into contact with the peripheral surface of either of the fixation rollers 21. Therefore, the fixing apparatus in this embodiment can prevent the problem that when a large sheet of a recording medium is conveyed through the fixing apparatus, one or both of the end portions of the sheet in terms of the widthwise direction come into contact with the fixation roller of the first fixing device and/or the fixation roller of the second fixing device, between the first and second fixing devices. Therefore, it can prevent an image forming apparatus from outputting defective images, the defects of which are attributable to the contact between the slackened portion of the sheet of the recording medium and one or both of the fixation rollers.

Embodiment 2

Figure 10:
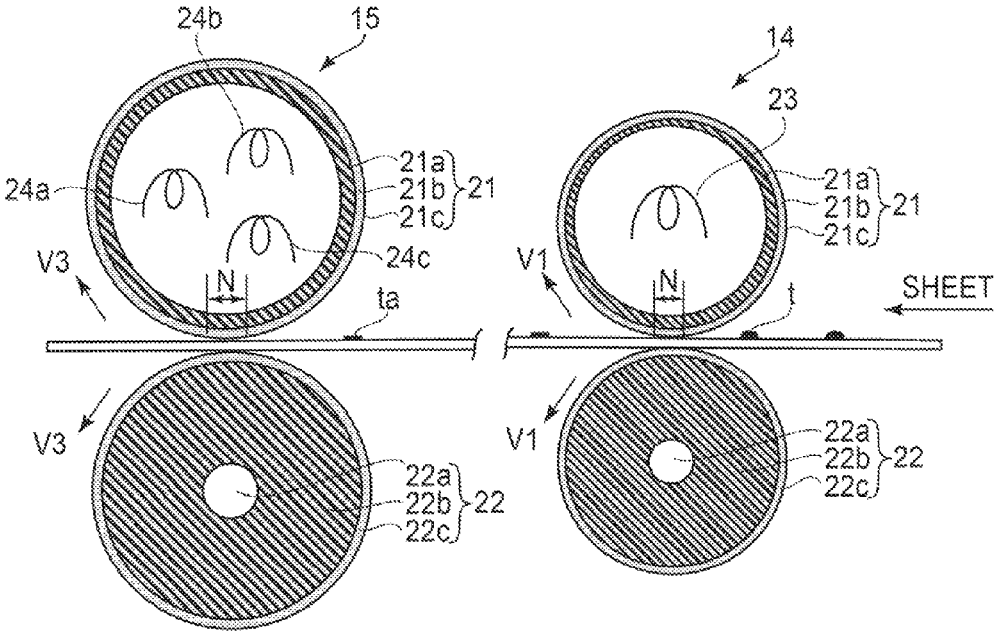
FIG. 10 is a schematic sectional view of the first and second fixing devices of the fixing apparatus in the second preferred embodiment of the present invention, at a plane perpendicular to the axial lines of each of the four rollers of the fixing apparatus.
Figure 11:
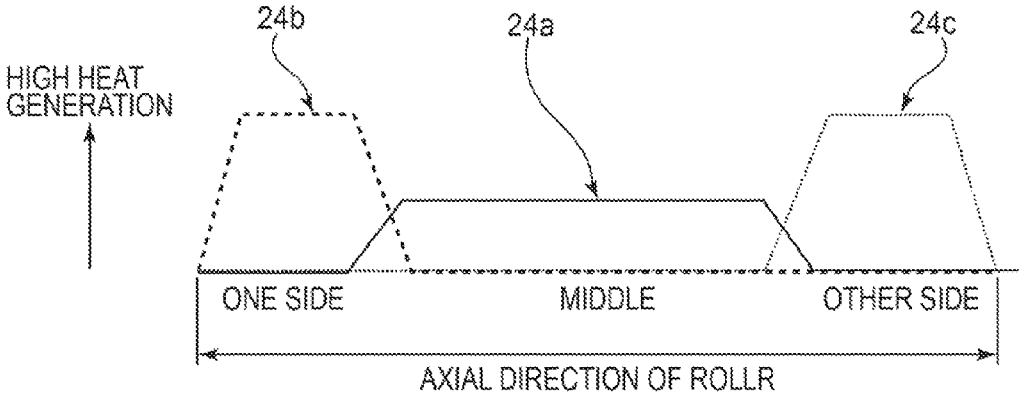
FIG. 11 is a drawing which shows the distribution of the heat from the halogen heater in the hollow of the fixation roller of the first fixing device of the fixing apparatus in the second preferred embodiment of the present invention.
Figure 12:
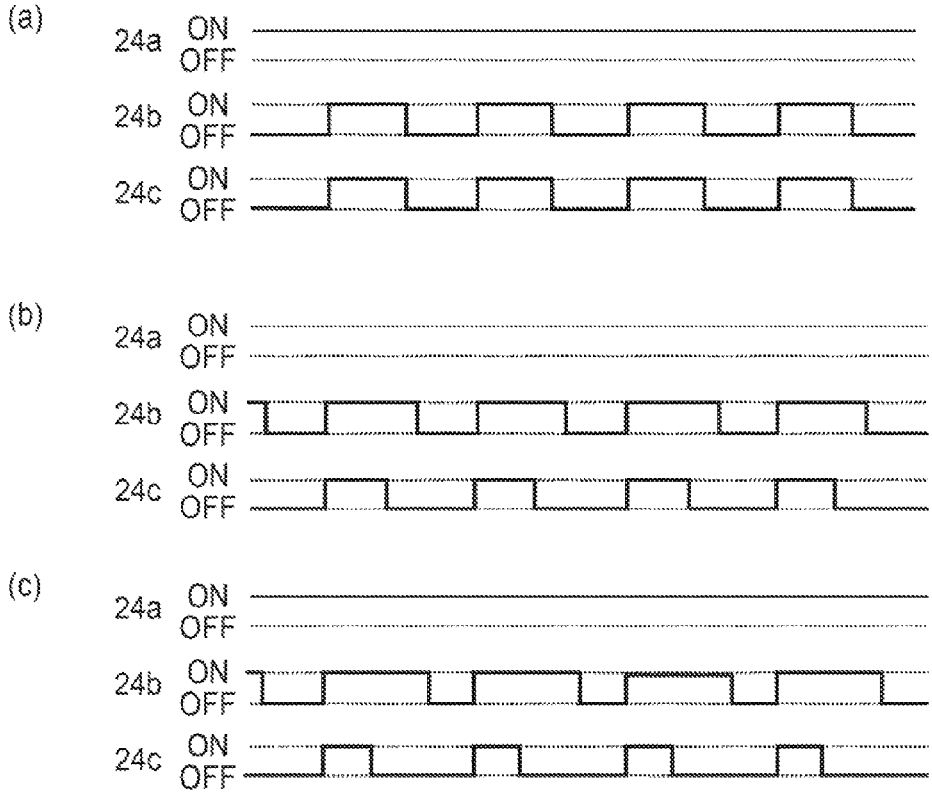
FIG. 12(*a*) is a schematic drawing which shows the pattern in which the sections 24*a*, 24*b*, and 24*c* of the halogen heater of the first fixing device of the fixing apparatus in the second embodiment are turned on and off to maintain the temperature of the fixation roller at the fixation temperature level.

First, another example of a fixing apparatus of the so-called tandem type is described. FIG. 10 is a schematic sectional view of the first and second fixing devices of the fixing apparatus in this embodiment (second embodiment) of the present invention, at a plane perpendicular to the axial line of each of the fixation rollers and pressure rollers of the fixing apparatus. FIG. 11 is a drawing which shows the distribution of the amount by which heat is generated by the halogen heater in the hollow of the fixation roller of the first fixing device of the fixing apparatus in the second embodiment, in terms of the lengthwise direction of the heater. FIG. 12(*a*) is a schematic drawing which shows the pattern in which the sections 24*a*, 24*b*, and 24*c* of the halogen heater of the first fixing device of the fixing apparatus in the second embodiment are turned on and off to keep the temperature of the fixation roller at the fixation temperature level. FIGS. 12(*b*) and 12(*c*) are schematic drawings which show the patterns, respectively, in which the sections 24*a*, 24*b*, 24*c* of the halogen light are turned on and off, and which are different from FIG. 12(*a*) in terms of the ratio with which the three sections 24*a*, 24*b*, and 24*c* of the halogen heater are turned on per unit length of time.

The fixation roller 21 and the pressure roller 22 of the second fixing device 15 of the fixing apparatus in this embodiment are 50 mm in external diameter. The second fixing device has three halogen heaters 24*a*, 24*b*, and 24*c*, which are heating members for changing how the fixation roller 21 is heated. The heaters 24*a*, 24*b*, and 24*c* are in the hollow of the fixation roller 21. Otherwise, the fixing apparatus in this embodiment is the same in structure as the fixing apparatus in the first embodiment.

The fixation roller 21 is made up of a cylindrical metallic core 21*a* and an elastic layer 21*b*. The cylindrical metallic core 21*a* is made of iron. The elastic layer 21*b* is formed of silicone rubber, and is 1.0 mm in thickness. It covers the entirety of the peripheral surface of the metallic core 21*a*. The fixation roller 21 has also a parting layer 21*c*, which is formed of a piece of PFA tube. It is 30 μm in thickness, and covers the entirety of the elastic layer 21*b*. The pressure roller 22 is made up of a metallic core 22*a* and an electric layer 22*b*. The metallic core 22*a* is in the form of a piece of iron rod which is 20 mm in diameter. The elastic layer 22*b* is made of sponge, more specifically, foamed silicone rubber, and covers the entirety of the peripheral surface of the metallic core 22*a*. The pressure roller 22 has also a parting layer 22*c*, which is 30 μm in thickness. The parting layer 22*c* is a piece of PFA tube, and covers the entirety of the peripheral surface of the elastic layer 22*b*. The fixation roller 21 and the pressure roller 22 are rotatably supported by the frame (unshown) of the fixing apparatus, at their lengthwise end portions of the metallic cores 21*a* and 22*a*, respectively, with the placement of a pair of bearings between the lengthwise ends of the metallic cores 21*a* and 22*a*, and the frame of the fixing apparatus. Further, the bearings for the pressure roller 22 are under the pressure generated by a pressure applying members (unshown) such as compression springs which keep the pressure roller 22 biased in the direction (toward) perpendicular to the generatrix of the fixation roller 21. The overall amount of the pressure applied to the bearings is roughly 490 N (50 kgf). Therefore, the elastic layer 22*b* of the pressure roller 22 remains deformed across the portion which is in contact with the fixation roller 21. Thus, there is a nip N between the peripheral surface of the fixation roller 21 and the peripheral surface of the pressure roller 22. The nip N has a preset width.

Referring to FIG. 11, among the three halogen heaters 24*a*, 24*b*, and 24*c*, the halogen heater 24*a* is such a heater that its center portion, in terms of its lengthwise direction, is greater in the amount of heat generation than its lengthwise end portions. The halogen heater 24*b* is such a heater that its lengthwise end portions are greater in the amount of heat generation than its center portion. The halogen heater 24*c* is such a heater that the amount of heat generated by one of its lengthwise end portions is greater than the amount of heat generation by the other lengthwise end portion. Further, the amount of heat each of the lengthwise end portions of the halogen heater 24*b* is capable of generating is greater than the amount by which the center portion of the halogen heater 24*c* is capable of generating. It has been known that normally, as the fixation roller 21 increases in temperature, the nip N widens because of the thermal expansion of the fixation roller 21. Thus, if the halogen heater 24*b* is greater in the ratio at which it is kept turned on per unit length of time than the halogen heater 24*c* (FIG. 12(*b*)), the portion of the nip N, which corresponds to one of the lengthwise portions of the fixation roller 21 (which hereafter may be referred to as first side) becomes wider than the portion of the nip N, which corresponds to the other lengthwise end portion of the fixation roller 21 (which hereafter may be referred to as second side). Thus, the speed with which a large sheet Pa of the recording medium is conveyed in the portion of the nip N, which corresponds to the first lengthwise end portions of the fixation roller 21, becomes faster than the speed with which the large sheet Pa is conveyed in the portion of the nip N, which corresponds to the second lengthwise end portion of the fixation roller 21. On the other hand, if the ratio of the time the halogen heater 24*c* is kept turned on per unit length of time is made greater than the ratio of the time the halogen heater 24*b* is kept turned on per unit length of time (unshown), the portion of the nip N, which corresponds to the second lengthwise end portion of the fixation roller 21 becomes wider than the portion of the nip N, which corresponds to the first lengthwise end portion of the fixation roller 21. Thus, the speed with which a large sheet PA of the recording medium is conveyed in the portion of the nip N, which corresponds to the second lengthwise end portion of the fixation roller 21, becomes faster than the speed with which a large sheet Pa of the recording medium is conveyed, than the portion of the nip N, which corresponds to the first lengthwise end portion of the fixation roller 21. The halogen heaters 24*a*, 24*b*, and 24*c* are supplied with a preset amount of electric power by a power supply control portion (unshown). As they are turned on (FIG. 12(*a*)), they generate heat. As heat is generated by the halogen heaters 24*a*, 24*b*, and 24*c*, the metallic core 21*a* of the fixation roller 21 is heated from within. As the fixation roller 21 is heated, its surface temperature is detected by a temperature detecting member (unshown) such as a thermistor located in the adjacencies of the peripheral surface of the fixation roller 21. The output signals from the temperature detecting member are taken in by the control portion 60, which controls the power supply control portion in response to the output signals from the temperature detecting member, in such a manner that the surface temperature of the fixation roller 21 remains at a preset fixation level (target level). In this embodiment, the fixation temperature (target temperature level) is 170° C.

Next, referring to FIGS. 4 and 12, a control sequence is described that is to be carried out by the control portion 60 to change the recording medium conveyance speed and the ratio of the time the halogen lamp heaters 24*a*-24*c* are turned on per unit length of time of the second fixing device 15 when the amount of slack of one side of a large sheet Pa of the recording medium in terms of its widthwise direction becomes greater than the amount of slack of the other side of the large sheet Pa.

As a large sheet Pa of the recording medium is pinched by the nip N of the second fixing device 15, and begins to be conveyed, and remains pinched through the fixing device 15 (T1 in FIG. 4), the amount of slack of the large sheet Pa begins to increase. Thus, the outputs of the slack amount sensors 31 and 32 increase (T1-T2 in FIG. 4).

As soon as the control portion 60 determines based on the outputs of the slack amount sensors 31 and 32 that the amount of slack of one side of the large sheet Pa of the recording medium in terms of the widthwise direction of the sheet Pa is greater than the amount of slack of the other side, it changes the ratio of the time the halogen lamps 24*a*-24*c* are kept turned on per unit length of time. That is, in order to effectively increase the recording medium conveyance speed, one side of the nip N of the second fixing device 15 in terms of the lengthwise direction of the nip N, the control portion 60 increases the ratio of the time the halogen lamp 24*c* is kept turned on per unit length of time, while leaving as it is the ratio of the time the halogen lamp 24*a* is kept turned on per unit length of time (FIG. 12(*b*)). Thus, one side of the nip N of the second fixing device 15 in terms of the lengthwise direction of the nip N becomes faster in recording medium conveyance speed than the other side. Therefore, the corresponding side of the large sheet Pa is pulled faster in the recording medium conveyance direction by the corresponding side of the fixation roller 21. Thus, the amount of slack at the corresponding side (portion δ1) of the large sheet Pa gradually becomes smaller. Then, if it is determined based on the outputs from the slack amount sensors 31 and 32 that the amount of slack of the portion δ1 of slackened portion of the large sheet Pa, which corresponds in position to one side of large sheet Pa in terms of the widthwise direction of the sheet Pa is greater than the amount of slack than the portion δ2, which corresponds in position to the other side, the control portion 60 changes again the ratio of the length of time the halogen lamps 24*a*-24*c* are kept turned on. That is, the control portion 60 increases the ratio of the length of time the halogen lamp 24*b* is kept turned on per unit length of time, while keeping the same the ratio of the length of time the lamp 24*a* is kept turned on per unit length of time (FIG. 12(*c*)). Thus, the recording medium conveyance speed of one side of the nip N of the second fixing device 15 in terms of its lengthwise direction becomes even faster than the other side. Therefore, the first widthwise end portion of the large sheet Pa is pulled even faster in the recording medium conveyance direction than the second widthwise end portion of the sheet Pa. Therefore, the amount of slack of the portion δ1, which corresponds to the first widthwise end portion of the large sheet Pa becomes even smaller. Then, as the outputs of the slack amount sensors 31 and 32 become equal, reflecting the states of the portions δ1 and δ2 of the slackened portion of the large sheet Pa, which correspond in position to the first and second widthwise end portions, one for one, of the large sheet Pa, the control portion 60 changes the ratio of the length of time the halogen heaters 24*b* and 24*c* are kept turned on per unit length of time, to the value at which the temperature of the fixation roller 21 remains at a preset level (FIG. 12(*a*)). Thereafter, as the output of the slack amount sensor 32 reaches the preset slack amount control start level L1 (T2 in FIG. 4), the control portion 60 changes the recording medium conveyance speed of the second fixing device 15 from V3 to V2, which is faster than the recording medium conveyance speed V1 of the first fixing device 14 (V2>V1>V3). As the second fixing device 15 increases the recording medium conveyance speed from V3 to V2, the amount of slack of the portions δ1 and δ2 of the slackened portion of the large sheet Pa of recording medium begins to decrease. Therefore, the outputs of the slack amount sensors 31 and 32 decrease (Figure T2-T3 in FIG. 4). If the outputs of the slack amount sensors 31 and 32 become different as described above even after the recording medium conveyance speed of the second fixing device 15 is changed from V3 to V2, the control portion 60 changes the ratio of the time the halogen lamps 24*b* and 24*c* are kept turned on per unit length of time. Then, as the outputs of the slack amount sensors 31 and 32 become equal, the control portion 60 changes the ratio of the amount of time the halogen heaters 24*b* and 24*c* are kept turned on per unit length of time, back to the value at which the temperature of the fixation roller 21 remains at the fixation level. Then, as the output of the slack amount sensor 32 reaches the slack amount control start level L2 (T3 in FIG. 4), the control portion 60 changes the recording material conveyance speed of the second fixing device 15 from V2 to V3. As the second fixing device 15 changes in the recording medium conveyance speed from V2 to V3, the amount of slack of the large sheet Pa of the recording medium gradually increases. Thus, the outputs of the slack amount sensors 31 and 32 increase (T3-T4 in FIG. 4). The control portion 60 repeats the above-described steps until the trailing edge of the large sheet Pa is discharged from the nip N of the second fixing device 15.

In the case of the fixing apparatus in this embodiment, if the amount of slack of the portion δ2 of the slackened portion of the large sheet Pa of the recording medium, which corresponds in position to the second widthwise end portion of the large sheet Pa of the recording medium is greater than the amount of slack of the portion δ1 of the slackened portion of the large sheet Pa, which corresponds in position to the first widthwise end portion of the sheet Pa, the control portion 60 changes the ratio of the time the halogen heaters are kept turned on per unit length of time, in order to increase the second fixing device 15 in its recording medium conveyance speed on the second side of its nip N. That is, the control portion 60 increases the ratio of the time the halogen lamp 24*c* is kept turned on per unit length of time to be greater than the ratio of the time the halogen lamp 24*b* is kept turned on per unit length of time, which is kept unchanged. Thus, the second side of the nip N of the second fixing device 15 in terms of the lengthwise direction of the nip N becomes faster in the recording medium conveyance speed than the first side of the nip N. Thus, the portion of the large sheet Pa of recording medium, which corresponds in position to the second lengthwise end portion of the fixation roller 21 is pulled faster by the faster recording medium conveyance speed than the portion of the large sheet Pa which corresponds in position to the first lengthwise end portion of the fixation roller 21. Therefore, the amount of slack of the portion δ2 of the slackened portion of the large sheet Pa, which corresponds in position to the second widthwise end portion of the large sheet Pa gradually decreases. Then, as the outputs of the slack amount sensors 31 and 32 become equal, that is, as the amount of slack of the portions δ1 and δ2 of the large sheet Pa, which correspond in position to the first and second sides of the fixation roller 21 in terms of the lengthwise direction, become equal, the control portion 60 changes the ratio of the time the halogen heaters 24*b* and 24*c* are kept turned on per unit length of time, back to the value for keeping the temperature of the fixation roller 21 at the fixation level. Then, as the output of the slack amount sensor 31 reaches the slack amount control start level L1, the control portion 60 changes the recording medium conveyance speed of the second fixing device 15 from V3 to V2, which is faster than the recording medium conveyance speed V1 of the first fixing device 14 (V2>V1>V3). If the outputs of the slack amount sensors 31 and 32 become different, as described above, even after the recording medium conveyance speed of the second fixing apparatus 15 was changed from V3 to V2, the control portion 60 changes the ratio of the time the halogen lamps 24*b* and 24*c* are kept turned on per unit length of time. Then, as the output of the slack amount sensor 31 reaches the preset slack amount control start level L2, the control portion 60 changes the recording medium conveyance speed of the second fixing apparatus 15 d from V2 to V3. The control portion 60 repeats the above-described steps until the trailing edge of the large sheet Pa of recording medium is discharged from the nip N of the second fixing device 15.

The halogen heater settings of the fixing apparatus in this embodiment are controlled so that the outputs of the slack amount sensors 31 and 32, which correspond in position to the lengthwise end portion of the fixation roller of the second fixing device, become equal. Thus, it is adjusted in such a manner that when a large sheet of a recording medium is conveyed through the fixing apparatus, the amount of slack of the two sides of a large sheet of the recording medium, in terms of its widthwise direction, become equal. Further, the recording material conveyance speed of the second fixing device is increased or reduced relative to the first fixing device to prevent the slackened portion of the large sheet of recording medium from coming into contact with the peripheral surface of the fixation rollers after the amount of slack of the large sheet of the recording medium becomes uniform in terms of its widthwise direction. That is, the fixing apparatus in this embodiment also can prevent the problem that the portion of the large sheet P of the recording medium, which is being slackened between the first and second fixing devices, comes into contact with the fixation rollers by one of its widthwise end portion or the entirety of the slackened portion. Therefore, it can prevent an image forming apparatus from outputting defective images, the defects of which are attributable to the contact between the slackened portion of recording medium and the fixation rollers.

Embodiment 3

Figure 13:
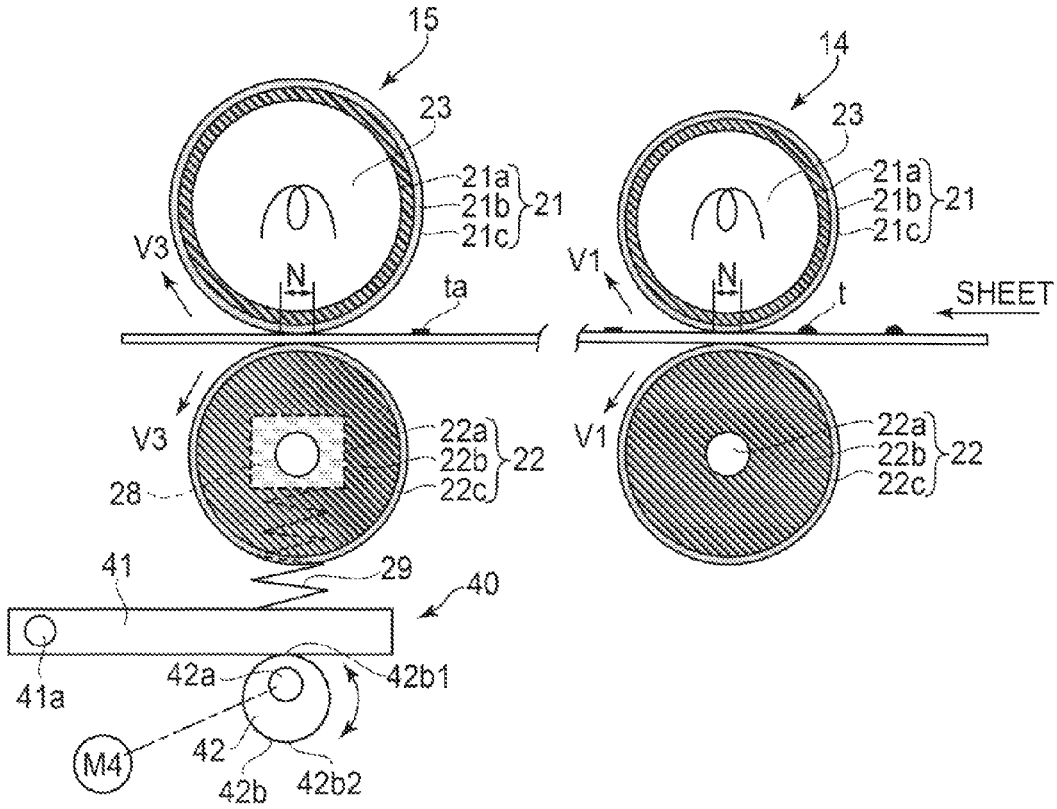
FIG. 13 is a schematic sectional view of the first and second fixing devices of the fixing apparatus in the third preferred embodiment of the present invention, at a plane perpendicular to the axial lines of each of the four rollers of the fixing apparatus.

Next, another example of a fixing apparatus of the so-called tandem type is described. FIG. 13 is a schematic sectional view of the first and second fixing devices of the fixing apparatus in the third embodiment of the present invention, at a plane perpendicular to the axial line of the fixation rollers and the pressure rollers of the fixing apparatus.

The fixation roller 21 of the second fixing device 15 of the fixing apparatus in the third embodiment is a roller which is 32 mm in external diameter. Further, the second fixing device of this fixing apparatus has a pressure application mechanism 40 as the pressure applying means of the second fixing device 15. Otherwise, the fixing apparatus in the third embodiment is the same in structure as the fixing apparatus in the first embodiment.

The fixation roller 21 is made up of a cylindrical metallic core 21*a* and an elastic layer 21*b*. The cylindrical metallic core 21*a* is made of iron. The elastic layer 21*b* is formed of silicone rubber, and is 1.0 mm in thickness. It covers the entirety of the peripheral surface of the metallic core 21*a*. The fixation roller 21 has also a parting layer 21*c*, which is formed of a piece of PFA tube. It is 30 μm in thickness, and covers the entirety of the elastic layer 21*b*. In the case of a fixing device to be mounted in a color image forming apparatus, the parting layer 21*c* of the fixation roller 21 may be formed of silicone rubber impregnated with silicone oil, instead of being formed of the piece of PFA tube. Referring to FIG. 13, designated by a reference numeral 28 are a pair of bearings, which are at the lengthwise ends of the metallic core 22*a* of the pressure roller 22 of the second fixing device 15. The bearings 28 are supported by the frame in such a manner that they can be moved upward or downward (direction perpendicular to recording medium conveyance direction). There are two pressure application mechanisms 40, which are at the lengthwise ends of the pressure roller 22, one for one. Each pressure application mechanism 40 has a lever 41 and an eccentric rotational cam 42. The lever 41 supports a pressing member 29 for pressing the bearing 28. The eccentric rotational cam 42 is roughly in the form of a disc, and is for changing the lever 41 in the angle relative to the pressure roller 22. The rotational axis of the rotational eccentric cam 42 coincides with the rotational axis of a cam shaft 42*a*. The rotational eccentric cam 42 is rotated by a cam motor M4 (driving means) by way of the camshaft 42*a*. The cam motor M4 is driven by the control portion 60 so that it will stop after being rotated a preset number of times. Therefore, the rotational eccentric cam 42, which is rotated by the cam motor M4, stops after being rotationally moved by a preset number of times. The attitude in which the rotational eccentric cam 42 stops is such that the area 42*b*1 of the peripheral surface 42*b* (cam surface) of the rotational eccentric cam 42, which is closest to the camshaft 32*a*, is in contact with the lever 41. As the rotational eccentric cam 42 rotationally moves, the lever 41 rotationally moves (tilts) by a preset angle toward the pressure roller 22 about a lever supporting shaft 41*a* as the fulcrum of the lever 41*a*, and stops. As the lever 41 is moved as described above, the pressing member 29 is made to press the bearing 28 in the direction perpendicular to the direction of the generatrix of the fixation roller 21. Thus, the elastic layer 22*b* of the pressure roller 22 and the elastic layer 21*b* of the fixation roller 21 are compressed by a preset amount across their lengthwise direction, creating thereby a nip N having a preset dimension in terms of the recording medium conveyance direction. Generally speaking, as the pressure applied to the fixation roller 21 and the pressure roller 22 in the direction to press them against each other is increased, the nip N between the two rollers widens in the direction perpendicular to the recording medium conveyance direction, which in turn increases the fixing device in the recording medium conveyance speed. Thus, if the pressure applied to the lengthwise ends of the pressure roller 22 to press the pressure roller 22 upon the fixation roller 21 is increased only at one of the lengthwise ends of the pressure roller 22, the nip N changes in shape in such a manner that it becomes widest at its lengthwise end which corresponds to the lengthwise end of the pressure roller 22, at which the pressure was increased. Thus, the fixing device becomes non-uniform in terms of its lengthwise direction, in the recording medium conveyance speed, in such a manner that the closer it is to the lengthwise end at which the pressure was increased, the faster the speed with which it conveys the large sheet Pa of the recording medium. On the contrary, if the pressure applied to the pressure roller 22 to press the roller 22 upon the fixation roller 21 is made greater at the other lengthwise end of the pressure roller 22 than the aforementioned lengthwise end, the nip N changes in shape so that the it becomes widest at the lengthwise end of the pressure roller 22, which was increased in the amount applied to the pressure roller 22. Thus, the recording material conveyance speed of the fixing device becomes non-uniform in terms of the lengthwise direction, so that the closer it is to the lengthwise end of the pressure roller 22 at which the pressure applied to the pressure roller 22 was increased, the faster the speed with which the large sheet Pa of the recording medium is conveyed.

Next, referring to FIGS. 4 and 13, a control sequence is described that is to be carried out by the control portion 60 to change the recording material conveyance speed of the second fixing device 15 when the slack of the large sheet Pa of recording medium, which is being conveyed through the fixing apparatus, is non-uniform in terms of the widthwise direction of the sheet Pa, between the first and second fixing devices, and the operation of the pressure application mechanism 40.

As the large sheet Pa of the recording medium is pinched by the nip N of the second fixing device 15, and begins to be conveyed, and remains pinched in the nip N, by the second fixing device 15 (T1 in FIG. 4), the large sheet Pa begins to increase in the amount of slack across its widthwise direction, whereby the outputs of the slack amount sensors 31 and 32 are increased (T1-T2 in FIG. 4). As the control portion 60 determines based on the outputs of the slack amount sensors 31 and 32 that the amount of slack of the slackened portion δ1 of the large sheet Pa, which corresponds in position to one of the widthwise end of the sheet Pa, is greater than the amount of slack of the slacked portion δ2 of the sheet Pa, which corresponds in position to the other widthwise end of the sheet Pa, the control portion 60 activates the pressure application mechanism 40 to make the recording medium conveyance speed of the second fixing device 15 change in such a manner that the recording medium conveyance speed of the lengthwise end of the nip N of the second fixing device 15, which corresponds in position to the other widthwise end of the sheet Pa, increases. That is, the control portion 60 drives forward the cam motor M4, which is at the lengthwise end at which the amount of slack of the large sheet Pa was larger, to rotate the rotational eccentric cam 42 by a preset angle, and then, stops the cam 42. The attitude in which the rotational eccentric cam 42 will be when the cam motor M4 stops being driven is such that the area 42*b*1 of the peripheral 42*b* (cam surface) of the rotational eccentric cam 42, which is farthest from the camshaft 32*a*, is in contact with the lever 41. As the rotational eccentric cam 42 is rotated as described above, the lever 41 is rotationally moved about the lever supporting shaft 41*a* (as fulcrum) by a preset angle toward the pressure roller 22 from where it was, and then, stops. As the lever 41 is rotationally moved, the pressing member 29 presses the bearing 28 in the direction perpendicular to the direction of the generatrix of the fixation roller 21. Thus, the nip N changes in shape so that the corresponding lengthwise end of the nip N becomes wider than the other lengthwise end. Therefore, the recording medium conveyance speed of the second fixing device 15 becomes non-uniform in terms of its lengthwise direction in such a manner that the closer it is to the corresponding lengthwise end a given point in the nip N, the faster the recording medium conveyance speed becomes. Therefore, the closer it is to the corresponding lengthwise end of the second fixing device 15, the faster the large sheet Pa is pulled in the recording medium conveyance direction. Therefore, the large sheet Pa is conveyed in such a manner that the amount of slack of its portion δ1 of the slackened portion of the large sheet Pa, which corresponds in position to the first widthwise edge of the sheet Pa, gradually decreases. Then, as the outputs of the slack amount sensors 31 and 32 become equal, that is, as the amounts of slack of the portions δ1 and δ2 of the slackened portion of the large sheet Pa, which correspond in position to the first and second widthwise edges of the large sheet Pa, become equal, the control portion 60 changes the recording material conveyance speed of the rotational eccentric cam 42 in attitude back into the fixation temperature retention attitude, by rotating the cam motor M4 in reverse (FIG. 13). Then, as the output of the slack amount sensor 32 reaches the preset slack amount control start level L1 (T2 in FIG. 4), the control portion 60 changes the recording material conveyance speed of the second fixing device 15 from V3 to V2, which is greater than the recording medium conveyance speed V1 of the first fixing device 14 (V2>V1>V3). As the recording material conveyance speed of the second fixing device 15 is increased from V3 to V2, the amounts of slack of the portions δ1 and δ2 of the slackened portion of the large sheet Pa begin to be reduced. Thus, the outputs of the slack amount sensors 31 and 32 decrease (T2-T3 in FIG. 4). If the outputs of the slack amount sensors 31 and 32 become different as described above, even after the recording medium conveyance speed of the second fixing device 15 was changed from V3 to V2, the control motor 60 rotationally moves the rotational eccentric cam 42 by a preset angle by rotating forward the cam motor M4, and then, stops the cam 42. As the outputs of the slack amount sensors 31 and 32 become equal because of the rotation of the rotational cam 42 by the preset angle as described, the control portion 60 rotates the rotational eccentric cam 42 back into the fixation temperature retention attitude by rotating the cam motor M4 in reverse. Then, as the output of the slack amount sensor 32 reaches the preset slack amount control start level L2 (T3 in FIG. 4), the control portion 60 changes the recording medium conveyance speed of the second fixing device 15 from V2 to V3. As the recording medium conveyance speed of the second fixing device 15 is changed from V2 to V3, the amounts of slack of the portions δ1 and δ2 of the slackened portion of the large sheet Pa begin to gradually increase. Thus, the outputs of the slack amount sensors 31 and 32 increase (T3-T4 in FIG. 4). The control portion 60 repeats the above-described steps until the trailing edge of the large sheet Pa is discharged from the nip N of the second fixing device 15.

In this embodiment, as the amount of slack of the portion δ2 of the slackened portion of the large sheet Pa of recording medium, which corresponds in position to the second widthwise edge of the large sheet Pa, becomes larger than the amount of slack of the portion δ1 of the slackened portion of the large sheet Pa, which corresponds in position to the first widthwise edge of the large sheet Pa, the control portion 60 activates the pressure application mechanism 40 to control the second fixing device 15 in such a manner that the recording medium conveyance speed of the second side of the second fixing device 15 becomes faster than the first side. That is, as the control portion 60 rotates the rotational eccentric cam 42 by a preset angle by rotating forward the corresponding cam motor M4, that is, the cam motor M4 which corresponds in position to the widthwise edge of the large sheet Pa, which was determined to be larger in the amount of slack, and then, stops the rotational eccentric cam 42. Thus, the nip N of the second fixing device 15 changes in shape so that its lengthwise end on the second side in terms of the lengthwise direction becomes wider than its opposite lengthwise end. Therefore, the recording medium conveyance speed of the nip N becomes faster on the second side than on the first side. Thus, the large sheet Pa is pulled faster in the recording medium conveyance direction on the second side of the fixing apparatus than on the first side. Thus, the amount of slack of the portion δ2 of the slackened portion of the large sheet Pa, which is on the second side, gradually decreases. Then, as the outputs of the slack amount sensors 31 and 32 become equal, that is, as the amounts of slack of the portions δ1 and δ2, which are on the first and second side become equal, the control portion 60 rotates the rotational eccentric cam 42 back into the fixation temperature retention attitude by rotating the cam motor 4M in reverse. Then, as the output of the slack amount sensor 32 reaches the preset slack amount control start level L1, the control portion 60 changes the recording material conveyance speed of the second fixing device 15 from V3 to V2, which is faster than the recording medium conveyance speed V1 of the first fixing device 14 (V2>V1>V3). If the outputs of the slack amount sensors 31 and 32 become different as described above, even after the recording material conveyance speed of the second fixing device was changed from V3 to V2, the control portion 60 rotates forward the cam motor M4 by a preset angle the cam motor M4, and stops the rotation of the cam motor M4. Then, as the output of the slack amount sensor 32 reaches the preset slack amount control start level L2, the control portion 60 changes the recording medium conveyance speed of the second fixing device 15 from V2 to V3. The control portion 60 repeats the above-described steps until the trailing edge of the large sheet Pa is discharged from the nip N of the second fixing device 15.

The amount of pressure applied to the lengthwise end of portions of the pressure roller and the fixation roller of the second fixing device of the fixing apparatus in the third preferred embodiment is changed (adjusted) so that the outputs of the slack amount sensors become equal. Thus, it also is adjusted so that when a large sheet of recording medium is conveyed through the fixing apparatus, not only is the portion of the large sheet Pa between the first and second fixing devices slackened, but also, the amounts of slack of the slackened portion becomes uniform in terms of the lengthwise direction of the fixing apparatus. Further, in order to prevent the slackened portion of the large sheet Pa from coming into contact with the peripheral surface of the fixation rollers, the recording material conveyance speed of the second fixing device is increased or decreased relative to the first fixing device after the amounts of slack of the slackened portion of the large sheet becomes uniform in terms of the widthwise direction of the large sheet (lengthwise direction of fixing apparatus). That is, the fixing apparatus in this embodiment also can prevent the problem that when a large sheet of recording medium is conveyed through a fixing apparatus structured so that when a large sheet of recording medium is conveyed through the fixing apparatus, it is slackened between the first and second fixing devices of the fixing apparatus, the slackened portion of the large sheet comes into contact with the fixation rollers of the first and second fixing devices at one of the lengthwise end of the fixing apparatus, and/or across the entirety of the fixing apparatus. Therefore, it can prevent an image forming apparatus from outputting defective images, the defects of which are attributable to the contact between a sheet of the recording medium and the fixation rollers.

Embodiment 4

Figure 14:
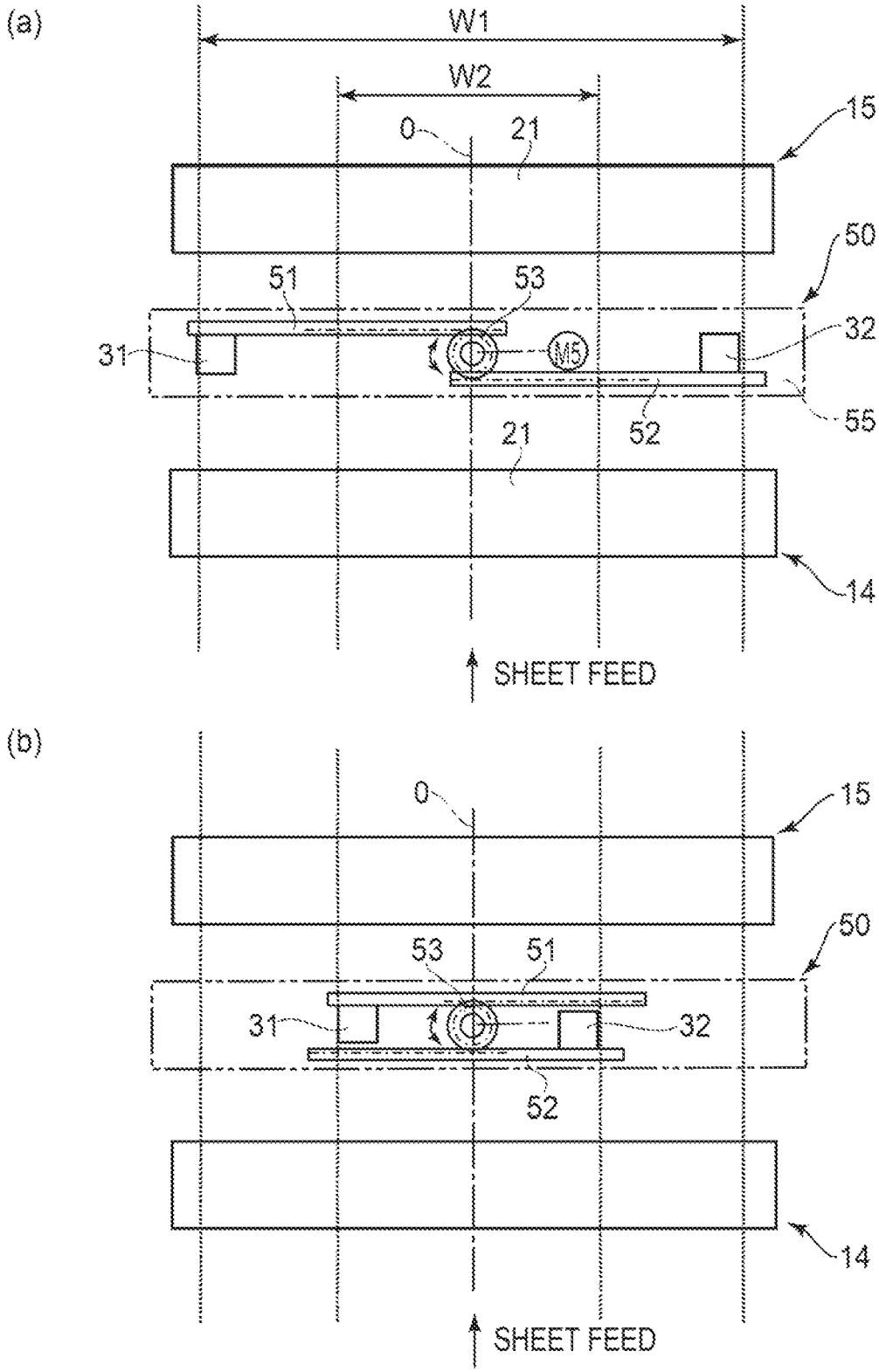
FIGS. 14(*a*) and 14(*b*) are schematic top plan views of the first and second fixing devices and slack amount sensors of the fixing apparatus in the fourth preferred embodiment of the present invention, and is for describing the operation of the sensor moving mechanism, FIGS. 14(*a*) and 14(*b*) being different in the location of the first and second sensor moving racks of the sensor moving mechanism.

Next, another example of a fixing apparatus of the so-called tandem type is described. FIG. 14(*a*) is a schematic top plan view of the first and second fixing device and sensor moving mechanism of the fixing apparatus in the fourth preferred embodiment of the present invention, as seen from above the fixation roller. FIG. 14(*b*) is a schematic top plan view of the first and second fixing devices and sensor moving mechanism of the fixing apparatus, and shows the operation of the sensor moving mechanism.

The fixing apparatus in the fourth embodiment is structured so that the slack amount sensors 31 and 32 can be moved into the path of the large sheet Pa of the recording medium with the use of a sensor moving mechanism 50 (sensor moving means). Otherwise, this fixing apparatus is the same in structure as the fixing apparatus in the first embodiment.

The sensor moving mechanism 50 in this embodiment is a rack-and-pinion mechanism. It has a first rack 51 and a second rack 52. The first rack 51 supports the slack amount sensor 31, which is the sensor on the first side in terms of the widthwise direction of the large sheet Pa of recording medium, and the second rack 52 supports the slack amount sensor 32, which is the sensor on the second side. The sensor moving mechanism 50 has also a supporting member 55, which is between the first and second fixing devices 14 and 15 of the fixing apparatus, and extends in the direction parallel to the lengthwise direction of the fixation roller 21 of the first fixing device 14 and the fixation roller 21 of the second fixing device 15. The first and second racks 51 and 52, respectively, are on the surface of the supporting member 55, which faces the path of the large sheet Pa. The first and second racks 51 and 52 are perpendicular to the recording medium conveyance direction and oppose each other. They are movable in the widthwise direction of the large sheet Pa. As the pinion 53 which is supported between the first and second racks 51 and 52 by the supporting member 55 in such a manner that it is in meshing engagement with the two racks 51 and 52 and is rotated, the first and second racks 51 and 52 are moved in the widthwise direction of the large sheet Pa, while remaining symmetrical to each other about the axial line of the pinion gear 53. Referring to FIG. 14, a pair of two-headed arrow marks designed by reference characters W1 and W2 are the width of the path of the largest sheet of the recording medium and the width of the path of the smallest sheet of the recording medium, respectively, which are usable with the image forming apparatus. The recording medium sheet size is inputted into the control portion 60 by a user, or the recording medium sheet width is inputted into the control portion 60 based on the information from an automatic recording medium sheet width detecting mechanism (unshown) of a recording medium sheet feeder cassette or the like. The control portion 60 controls (drives) a sensor moving motor M5 (sensor moving means supported by the supporting member 55), based on the inputted information. FIG. 14(*b*) shows the state of the second fixing device 15 after the slack amount sensors 31 and 32 have been moved immediately inward of the path of the smallest sheet of the recording medium on the first and second sides, respectively, in terms of the widthwise direction of the sheet path.

The fixing apparatus in this embodiment is structured so that the slack amount sensors are movable in the widthwise direction of the recording medium sheet path, to preset locations according to the width of the recording medium sheet. Therefore, regardless of the size of the sheet of recording medium, it can prevent the problem that the slackened portion of the sheet of the recording medium comes into contact with the fixation rollers at one of the lengthwise end of the fixing apparatus, or across the entirety of the fixing apparatus. Therefore, it can prevent an image forming apparatus from outputting defective images, the defects of which are attributable the contact between the slackened portion of the sheet of recording medium and one or both of the fixation rollers. Although the fourth preferred embodiment of the present invention was described with reference to the image forming apparatus created by providing the image forming apparatus in the first embodiment with the sensor moving mechanism, the application of the sensor moving mechanism is not limited to image forming apparatuses such the one in the first embodiment. That is, the sensor moving mechanism may be applied to image forming apparatuses such as those in the third and fourth embodiments.

According to the present invention, it is possible to provide an image heating apparatus which can reliably convey a sheet of the recording medium, while slightly slackening the sheet of the recording medium between its upstream and downstream image heating units in terms of the recording medium conveyance direction, even if the recording material conveyance speed temporarily becomes non-uniform, in terms of the widthwise direction of the sheet of recording medium.

While the invention has been described with reference to the structures disclosed herein, it is not confined to the details set forth, and this application is intended to cover such modifications or changes as may come within the purposes of the improvements or the scope of the following claims.

What is claimed is:

1. An image heating apparatus comprising:

first image heating means, having a nip through which a recording material passes, for heating a toner image on the recording material;

second image heating means, having a nip through which the recording material passes, for heating the toner image on the recording material having passed through the nip of said first image heating means;

speed changing means for changing a feeding speed of the recording material of said second image heating means;

a first detector configured to detect an amount of slack of the recording material at one end of the recording material when the recording material is nipped by both of the nip of said first image heating means and the nip of said second image heating means;

a second detector configured to detect an amount of slack of the recording material at the other end of the recording material when the recording material is nipped by both of the nip of said first image heating means and the nip of said second image heating means;

adjusting means for adjusting the difference between the amount of slack at said one end of the recording material and the amount of slack at the other end of the recording material; and an executing portion configured to execute a correction mode when the amount of slack at said one end of the recording material detected by said first detector and the amount of slack at the other end of the recording material detected by said second detector are different from each other, wherein said executing portion executes the correction mode in which after said adjusting means reduces the difference between the amount of slack at the one end of the recording material and the amount of slack at the other end of the recording material by changing the position of said second image heating means at the other end of the recording material while fixing the position of said second image heating means at the one end of the recording material, the feeding speed of the recording material is controlled by said speed changing means.

2. An apparatus according to claim 1, wherein the position of said first image heating means is fixed.

3. An apparatus according to claim 1, further comprising moving means for moving said first detector and said second detector in a widthwise direction of the recording material to predetermined positions corresponding to a width of the recording material.

4. An image heating apparatus comprising:

first image heating means, having a nip through which a recording material passes, for heating a toner image on the recording material;

second image heating means, having a nip through which the recording material passes, for heating the toner image on the recording material having passed through the nip of said first image heating means;

speed changing means for changing a feeding speed of the recording material of said second image heating means;

a first detector configured to detect an amount of slack of the recording material at one end of the recording material when the recording material is nipped by both of the nip of said first image heating means and the nip of said second image heating means;

a second detector configured to detect an amount of slack of the recording material at the other end of the recording material when the recording material is nipped by both of the nip of said first image heating means and the nip of said second image heating means;

adjusting means for adjusting a feeding speed at which said second image heating means feeds the recording material at said one end of the recording material and a feeding speed at which said second image heating means feeds the recording material at the other end of the recording material; and an executing portion configured to execute a correction mode when the amount of slack at said one end of the recording material detected by said first detector and the amount of slack at the other end of the recording material detected by said second detector are different from each other, wherein said executing portion executes the correction mode in which after said adjusting means reduces the difference between the amount of slack at said one end of the recording material and the amount of slack at the other end of the recording material, the feeding speed of the recording material is controlled by said speed changing means.

5. An apparatus according to claim 4, wherein said adjusting means adjusts the amount of heat generation of said second image heating means at said one end of the recording material and the amount of heat generation of second image heating means at the other end of the recording material.

6. An apparatus according to claim 4, wherein the positions of said first image heating means and second image heating means are fixed.

7. An apparatus according to claim 4, wherein said adjusting means adjusts the pressure of said nip of said second image heating means at said one end of the recording material and the pressure of said nip of said second image heating means at the other end of the recording material.

8. An image heating apparatus comprising:

a first image heater, having a nip through which a recording material passes, configured to heat a toner image on the recording material;

a second image heater, having a nip through which the recording material passes, configured to heat the toner image on the recording material having passed through the nip of said first image heater;

a speed changing device configured to change the feeding speed of the recording material of said second image heater;

a first detector configured to detect an amount of slack of the recording material at one end of the recording material when the recording material is nipped by both of the nip of said first image heater and the nip of said second image heater;

a second detector configured to detect an amount of slack of the recording material at the other end of the recording material when the recording material is nipped by both of the nip of said first image heater and the nip of said second image heater;

an adjusting device configured to adjust the difference between the amount of slack at said one end of the recording material and the amount of slack at the other end of the recording material; and an executing portion configured to execute a correction mode when the amount of slack at said one end of the recording material detected by said first detector and the amount of slack at the other end of the recording material detected by said second detector are different from each other, wherein said executing portion executes the correction mode in which after said adjusting device reduces the difference between the amount of slack at the one end of the recording material and the amount of slack at the other end of the recording material by changing the position of said second image heater at the other end of the recording material while fixing the position of said second image heater at the one end of the recording material, the feeding speed of the recording material is controlled by said speed changing device.

9. An image heating apparatus comprising:

a first image heater, having a nip through which a recording material passes, configured to heat a toner image on the recording material;

a second image heater, having a nip through which the recording material passes, configured to heat the toner image on the recording material having passed through the nip of said first image heater;

a speed changing device configured to change a feeding speed of the recording material of said second image heater;

a first detector configured to detect an amount of slack of the recording material at one end of the recording material when the recording material is nipped by both of the nip of said first image heater and the nip of said second image heater;

a second detector configured to detect an amount of slack of the recording material at the other end of the recording material when the recording material is nipped by both of the nip of said first image heater and the nip of said second image heater;

an adjusting device configured to adjust a feeding speed at which said second image heater feeds the recording material at said one end of the recording material and a feeding speed at which said second image heater feeds the recording material at the other end of the recording material; and an executing portion configured to execute a correction mode when the amount of slack at said one end of the recording material detected by said first detector and the amount of slack at the other end of the recording material detected by said second detector are different from each other, wherein said executing portion executes the correction mode in which after said adjusting device reduces the difference between the amount of slack at said one end of the recording material and the amount of slack at the other end of the recording material, the feeding speed of the recording material is controlled by said speed changing device.

* * * * *